US012296876B2

(12) United States Patent
Shue et al.

(10) Patent No.: US 12,296,876 B2
(45) **Date of Patent: *May 13, 2025**

(54) SYSTEM AND METHOD FOR REMOTE DEVICE MONITORING

(71) Applicant: BNSF Railway Company, Fort Worth, TX (US)

(72) Inventors: Kent Shue, Bonner Springs, KS (US); Carlos Aguilera, Lenexa, KS (US); Marcus Parrott, Kansas City, MO (US); Jerry Wade Specht, Overland Park, KS (US); Perry Peden, Jr., Overland Park, KS (US)

(73) Assignee: BNSF Railway Company, Fort Worth, TX (US)

( * ) Notice: Subject to any disclaimer, the term of this patent is extended or adjusted under 35 U.S.C. 154(b) by 524 days.

This patent is subject to a terminal disclaimer.

(21) Appl. No.: 17/703,471

(22) Filed: Mar. 24, 2022

(65) Prior Publication Data

US 2023/0122108 A1 Apr. 20, 2023

Related U.S. Application Data

(63) Continuation of application No. 17/506,071, filed on Oct. 20, 2021, now Pat. No. 11,305,796.

(51) Int. Cl.
*B61L 27/53* (2022.01)
*B61K 9/08* (2006.01)
(Continued)

(52) U.S. Cl.
CPC ..... *B61L 27/70* (2022.01); *B61K 9/08* (2013.01); *B61L 23/04* (2013.01); *B61L 23/042* (2013.01); *B61L 27/40* (2022.01); *B61L 27/53* (2022.01)

(58) Field of Classification Search
CPC ..... B61L 23/04; B61L 23/042; B61L 27/40; B61L 27/53; B61L 27/70; B61K 9/08
(Continued)

(56) References Cited

U.S. PATENT DOCUMENTS 7,705,743 B2 4/2010 Barone et al.
8,605,754 B2 12/2013 Siriwongrairat et al.
(Continued)

FOREIGN PATENT DOCUMENTS

CN 207965551 U 10/2018
EP 3199421 B1 5/2020
WO 2019185872 A1 10/2019

OTHER PUBLICATIONS

GE, Industrial Communication Solutions for the Rail Industry , Dec. 31, 2016.

(Continued)

*Primary Examiner* — Zachary L Kuhfuss
(74) *Attorney, Agent, or Firm* — Whitaker Chalk Swindle & Schwartz PLLC; Enrique Sanchez, Jr.

(57) ABSTRACT

A railroad infrastructure communication network is presented. The network can include a plurality of infrastructure nodes distributed proximate a railroad track, such as near railroad equipment and/or assets. Infrastructure nodes can be configured to receive data from equipment sensor and/or assets and transmit such data via the network. Infrastructure nodes can further generate alert and/or alert packets based on such received data. Infrastructure nodes can self-define in a network infrastructure depending on configured connection types, and can for example, serve as repeater nodes (to promulgate a transmission to additional infrastructure nodes) and/or collector nodes (to collect data for a centralized server node). A server node can be configured to receive data and/or packet from infrastructure nodes and generate requests for additional systems, personnel, etc. to address
(Continued)

such requests. The network can limit the data transmission size and leverage distributed processing capabilities to enable transmissions over long ranges, such as by reducing the bandwidth required to transmit packets.

20 Claims, 13 Drawing Sheets

(51) Int. Cl.
*B61L 23/04* (2006.01)
*B61L 27/40* (2022.01)
*B61L 27/70* (2022.01)

(58) Field of Classification Search
USPC ..... 701/19
See application file for complete search history.

(56) References Cited

U.S. PATENT DOCUMENTS 10,106,079 B2 10/2018 Denny et al.
11,305,796 B1 * 4/2022 Shue ..... B61L 23/04
2002/0027495 A1 * 3/2002 Darby, Jr. ..... B61L 25/025 340/298
2006/0085103 A1 * 4/2006 Smith, Jr. ..... H04B 7/0802 701/19
2007/0040070 A1 2/2007 Stevenson et al.
2009/0219900 A1 9/2009 Kokkinen et al.
2011/0026411 A1 * 2/2011 Hao ..... H04L 12/40189 370/249
2011/0075641 A1 * 3/2011 Siriwongpairat ..... H04W 4/12 370/337
2016/0046308 A1 2/2016 Chung et al.
2016/0052531 A1 2/2016 Boukari
2016/0144875 A1 * 5/2016 Kim, II ..... B61L 25/021 370/328
2016/0272228 A1 9/2016 LeFebvre et al.
2017/0001653 A1 * 1/2017 Ferencz, Jr. ..... G16Y 10/40
2017/0088046 A1 * 3/2017 Denny ..... H04W 24/04
2017/0279636 A1 * 9/2017 Giroud ..... H04L 12/437
2017/0320507 A1 9/2017 Denny et al.
2017/0282944 A1 * 10/2017 Carlson ..... G01S 19/17
2017/0313331 A1 * 11/2017 Hilleary ..... B61L 17/02
2018/0199237 A1 7/2018 Vare et al.
2019/0054942 A1 2/2019 Carlson
2019/0071106 A1 3/2019 Carlson
2019/0251804 A1 8/2019 Stogel
2019/0329806 A1 10/2019 Anderson et al.
2021/0291881 A1 9/2021 Morgart et al.
2023/0122108 A1 4/2023 Shue et al.

OTHER PUBLICATIONS

Aguilera, C. Remote Device Monitoring Abstract., Dec. 11, 2019.
Aguilera, C. Remote Device Monitoring Abstract., Jun. 3, 2020.
Aguilera, C. Remote Device Monitoring Abstract., May 8, 2020.
Aguilers—GNCC Presentation Pooled Fund Draft Jun. 17, 2020.
Aguilers—AREMA 2020 Remote Device Monitoring Presentation Jun. 4, 2020.
Aguilers—AREMA 2020 Remote Device Monitoring Presentation Aug. 21, 2020.

* cited by examiner

SYSTEM AND METHOD FOR REMOTE DEVICE MONITORING

CROSS-REFERENCE TO RELATED APPLICATIONS

The present application is a Continuation Application of U.S. patent application Ser. No. 17/506,071, filed on Oct. 20, 2021, entitled "SYSTEM AND METHOD FOR REMOTE DEVICE MONITORING," the contents of which are incorporated herein in their entireties for all purposes.

TECHNICAL FIELD

The present disclosure relates generally to communications network implementing a plurality of infrastructure nodes and/or one or more server nodes, specifically with respect to railroad infrastructure and signaling.

BACKGROUND

Rail transport systems traverse entire continents to enable the transport and delivery of passengers and goods throughout the world. A quintessential component of railroad infrastructure is the track—laid over a myriad of geographies and terrains, railroad tracks are designed to withstand the worst of the elements and facilitate disbursement of locomotives throughout the railroad system. Because of this constant exposure of the tracks to hazardous conditions, railroad companies must be vigilant in maintaining track integrity; if a section of track is compromised and the damage or obstruction is not quickly addressed, the consequences can be catastrophic. Further, railroad equipment dispersed proximate the track can also require attention and maintenance. For example, railroad crossings have gates, sensors, alerts, etc. that all must function properly to ensure prevention of cross-traffic on the track at inappropriate times.

Because of the wide dispersion of railroad assets amongst a railroad network, adequately monitoring some areas can be extremely difficult. With respect to positive train control (PTC), e.g. systems in place to prevent train collisions, this problem is addressed via extremely-long-range-capable communication infrastructure. When Positive Train Control (PTC) became a federal mandate in 2008, a new communication infrastructure was born on the railroad using the 220-222 MHz radio frequency. However, the 220 MHz radio network has limited bandwidth, and its primary purpose is to transmit and receive messages between trains and wayside locations for train safety.

Therefore, to address this problem without sacrificing PTC bandwidth, cellular networks have been widely used to remotely monitor locations throughout the recent history of the railroad. Cellular networks also suffer from a lack of coverage in some areas, preventing the use of cellular technologies to monitor certain locations. As more locations require cellular devices for monitoring (e.g., highway grade crossings, etc.), the costs for use also increases.

SUMMARY

The present disclosure achieves technical advantages as a system and method for enhancing communications in a railroad infrastructure. The system resolves the long-felt need for remote device monitoring without relying on cellular capabilities by implementing a plurality of infrastructure nodes configured to communicate with one another via a particular communications protocol. The system can include the capability of infrastructure nodes that can self-define in the network, automatically self-configuring to act as repeater nodes and/or collector nodes depending on configured connection types available to the node. In one embodiment, the node can be configured by the type of connection available. The system achieves a significant technical advantage in that long-range communications infrastructure can be leveraged for extremely-remote monitoring by creating a mesh network without congesting the communications infrastructure. The system implements a distributed processing network of infrastructure nodes, each capable of running an integration system consisting of specialized algorithms to receive data and/or packets, generate packets, utilize one or more communications protocols, and handle acknowledgments throughout the network. The system can use edge processing to limit the size of the messages that it transmits using LoRa until it finds a collector connected to the 220 MHz network.

The present disclosure solves the technological problem of enabling extremely-long-range communication. The present disclosure can include a centralized server node configured to collect data via collector nodes distributed throughout the network, and the collector nodes can be configured to receive data from repeater nodes throughout the network. A sequence of repeater nodes, which can be hundreds of miles away, can generate a signal and/or packet and transmit the information omni-directionally via a particular communications protocol. The repeater node can include specialized algorithms configured to generate packets specially-designed to function with a particular communications protocol, and when such packet is received by one or more other repeater nodes, the packet can be repeated continuously until the packet is received by a collector node. The collector node can forward the packet to a server and an acknowledgment can be generated and transmitted, informing the infrastructure nodes that transmission of the packet can be terminated. Each infrastructure node can be configured to perform processing on received packets, thereby reducing the overall bandwidth that the packet may ultimately require. Unlike most radios, this can be done automatically. The collector node can communicate via a plurality of communications protocol (e.g., a 220 MHz protocol, cellular protocols, etc.). In this manner, the present disclosure can enable long-range communications without over-congesting existing communications infrastructure, e.g., because data packets are collected at collector nodes, which can also further process packets (such as to minimize bandwidth requirements) and/or transmit packets in an orderly fashion, such that all infrastructure nodes are not taxing bandwidth of necessary communications infrastructure.

In one embodiment, the present disclosure can include infrastructure nodes and/or one or more server nodes. The infrastructure nodes can be configured with specialized algorithms designed to monitor discrete digital and analog I/O, apply alarm/alert processing application(s), and/or provide a software-defined mesh radio network. The server node(s) can be configured with specialized algorithms designed to collects health indication and alarms, provide a field user portal, and/or routes alarms to appropriate trouble ticket generator(s).

The present disclosure improves the performance and functionality of the system itself by implementing specialized algorithms adapted to receive, utilize, and generate data packets related to railroad alerts, such as alerts that can be generated by crossing equipment, high water sensors, avalanche sensors, slide fences, or any other railroad equipment.

The system can implement alert thresholds to determine whether sensor data received indicates that an alert should be generated, and/or to determine whether a data packet received from another system constituent indicates an alert. The system can further implement connection adapters, sensors, or any other hardware that is suitable to enable the system to facilitate remote device monitoring. The system provides a meaningful and extremely advantageous use for, e.g., certain communication protocols, such as the LoRa protocol, which is not configured for peer-to-peer communication.

The present disclosure provides the technical benefit of providing a system capable of leveraging the PTC 220 MHz Interoperable Train Control Messaging (ITCM) communications infrastructure without over-taxing bandwidth. It is a further object of the present disclosure to provide a peer-to-peer LoRa mesh radio network. It is a further object of the present disclosure to provide a system for providing a meaningful use for mass data by accomplishing distributed processing to minimize communications bandwidth required. These and other objects are provided by at least the following embodiments.

In one embodiment, a system for alert generation and handling in a railroad infrastructure, the system can comprise: a server node operably coupled with a first memory and a first computer processor, the first memory having a plurality of data, thresholds, and specifications related to railroad tracks and assets, and the first computer processor operably coupled to the first memory and capable of executing machine-readable instructions to perform first program steps; and a first infrastructure node operably coupled with a second memory and a second computer processor, the second memory having a plurality of data, thresholds, and specifications related to railroad tracks and assets, and the second computer processor operably coupled to the second memory and capable of executing machine-readable instructions to perform second program steps, the second program steps including: receiving sensor data related to a railroad asset; determining if the sensor data satisfies an alert threshold; generating an alert if the sensor data satisfies the alert threshold; determining at least one configured connection type; defining the first infrastructure node as being of a first node type if a first connection type is not configured on the first infrastructure node; defining the first infrastructure node as being of a second node type if the first connection type is configured on the first infrastructure node; transmitting the alert to at least a second infrastructure node if the first infrastructure node is the first node type; and transmitting the alert to the server node if the first infrastructure node is the second node type. Wherein the first program steps include: receiving the alert; generating an acknowledgment; transmitting the acknowledgment to at least the first infrastructure node; generating a request; and transmitting the request. Wherein the first program steps further include: determining if the request is acknowledged; retransmitting the request if the request is not acknowledged; and terminating the request if the request is acknowledged. Wherein the first infrastructure node is located proximate to a railroad track. Wherein the first infrastructure node is located at a crossing house. Wherein the railroad asset is a railroad crossing. Wherein the first infrastructure node transmits the alert to the second infrastructure node via a LoRa protocol. Wherein the second infrastructure node is of the second node type.

In another embodiment, a system for monitoring railroad infrastructure can comprise: a first infrastructure node operably coupled with a first memory and a first computer processor, the first memory having a plurality of data, thresholds, and specifications related to railroad tracks and assets, and the first computer processor operably coupled to the first memory and capable of executing machine-readable instructions to perform first program steps, the first program steps including: receiving a first packet having a first payload including railroad asset data; determining at least one configured connection type; defining the at least one infrastructure node as being of a first node type if a first connection type is not configured on the at least one infrastructure node; defining the at least one infrastructure node as being of a second node type if the first connection type is configured on the at least one infrastructure node; repeating the first packet via a second connection type if the at least one infrastructure node is of the first node type; processing the first packet to generate a second packet having a second payload if the at least one infrastructure node is of the second node type; and transmitting the second packet via the first connection type if the at least one infrastructure node is of the second node type and the first connection type is available. Wherein the first program steps further include transmitting the second packet via a third connection type if the at least one infrastructure node is of the second node type and the first connection type is not available. Wherein the first program steps further include: determining, using the first packet, if acknowledgment is required; requesting acknowledgment if acknowledgment is required; and terminating transmission of at least one of the first or second packet if acknowledgment is received. Further comprising a server node operably coupled with a second memory and a second computer processor, the second memory having a plurality of data, thresholds, and specifications related to railroad tracks and assets, and the second computer processor operably coupled to the second memory and capable of executing machine-readable instructions to perform second program steps, the second program steps including: receiving the second packet; identifying the second payload; generating an acknowledgment if the second payload requires acknowledgment; and transmitting the acknowledgment to the at least one infrastructure node. Wherein the second program steps further include generating a first request and transmitting the first request if the second payload includes an alert. Wherein the second program steps further include: determining if the second payload includes a node status; generating a second request if the node status indicates that node attention is required; and transmitting the second request. Wherein the first program steps further include: determining if the first payload has reached a first payload destination; if the first payload destination has been reached, processing the first packet, determining if acknowledgment is required, and, if acknowledgment is required, transmitting an acknowledgment;

In another embodiment, a communications system for monitoring railroad infrastructure can comprise: a plurality of infrastructure nodes, each infrastructure node including one or more node processors operably coupled to a node memory and capable of executing machine-readable instructions; a connectivity management system comprising: a connectivity monitoring module configured to determine, via the one or more node processors, at least one configured connection type; a definition module configured to define, via the one or more node processors, at least one infrastructure node as a first node type or a second node type using the at least one determined configured connection type; and a transmission module configured to transmit a plurality of data via one or more available connection types; a data management system comprising: a data collection module configured to receive sensor data and infrastructure node data packets; a status monitoring module configured to monitor node health via the one or more node processors; and an alert module configured to generate alerts using the sensor data; and a communications management system comprising: a data coordination module configured to determine, via the one or more node processors, one or more processing locations for the infrastructure node data packets; and an acknowledgment handling module configured to generate and request, via the one or more node processors, acknowledgments related to the infrastructure node data packets. Further comprising a server node including one or more server processors operably coupled to a server memory and capable of executing machine-readable instructions; a connectivity supervisor system comprising: a connections supervisor module configured to determine, via the one or more server processors, at least one configured connection type; a transmissions supervisor module configured to transmit a plurality of data via one or more available connection types; a data supervisor system comprising: a data accumulation module configured to receive infrastructure node data packets and generate a record, using the infrastructure node data packets, data related to infrastructure nodes and one or more railroad assets; a node monitoring module configured to monitor, using the infrastructure node data packets, health of a plurality of nodes via the one or more server processors; and an alert management module configured to receive alerts via the infrastructure data packets and generate requests in response to receiving alerts; and a communications supervisor system comprising: an acknowledgment supervisor module configured to generate and request, via the one or more server processors, acknowledgments related to the infrastructure node data packets and requests generated by the alert management module.

In another embodiment, a method of generating and transmitting alerts related to railroad assets, can comprise the steps of: receiving, via a first infrastructure node, sensor data related to a railroad asset; determining, via a first node computer processor, if the sensor data satisfies an alert threshold; generating an alert via the first node computer processor if the sensor data satisfies the alert threshold; transmitting the alert from the first infrastructure node to a second infrastructure node via a first communication protocol; determining, via a second node computer processor, if a second communication protocol is available to the second infrastructure node; repeating the alert to a third infrastructure node via the second infrastructure node using the first communication protocol if the second communication protocol is not available to the second infrastructure node; and transmitting the alert via the second infrastructure node using the second communication protocol if the second communication protocol is available to the second infrastructure node. Wherein the first communication protocol is LoRa protocol. Wherein the second communication protocol is compatible with a positive train control network.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

The disclosure presented in the following written description and the various features and advantageous details thereof, are explained more fully with reference to the non-limiting examples included in the accompanying drawings and as detailed in the description, which follow. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can visualize or recognize the members of the genus. Accordingly, these examples should not be construed as limiting the scope of the claims.

Figure 1:
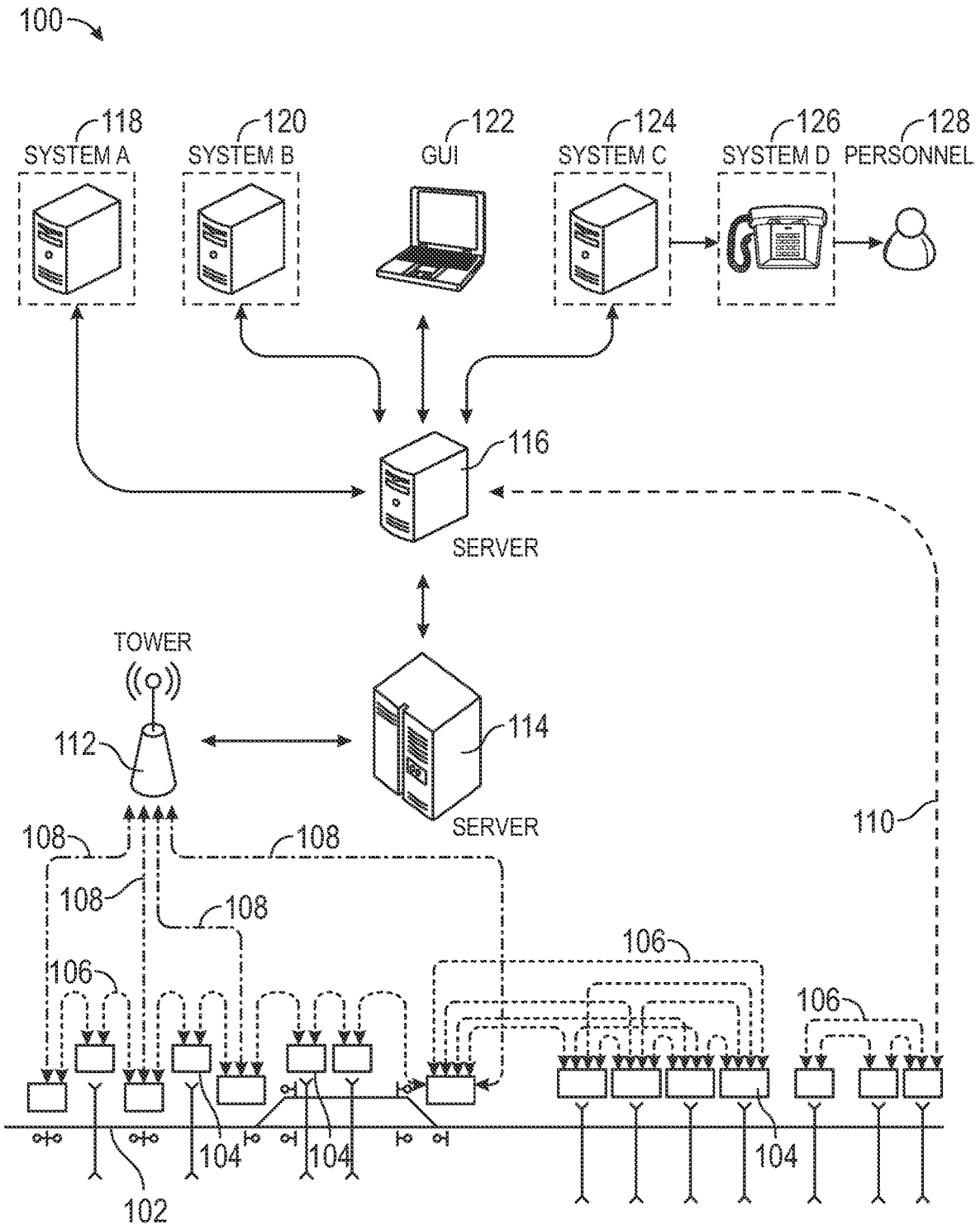
FIG. 1 illustrates a schematic view of a railroad communications infrastructure, in accordance with one or more exemplary embodiments of the present disclosure.

FIG. 1 illustrates a schematic view of a railroad communications infrastructure 100. The infrastructure 100 can include a plurality of infrastructure nodes 104 dispersed alongside a railroad track 102. The infrastructure nodes can include hardware, software, processors, modules, adapters, and/or any other elements suitable to enable the infrastructure nodes 104 to communicate with one another and/or other system constituents. In one embodiment, the infrastructure nodes 104 can communicate with each other via a first communications protocol 106. For example, the first communications protocol 106 can be a LoRa protocol. In another embodiment, the infrastructure nodes 104 can be configured to communicate with one or more servers 114, 116, such as via a second communication protocol 108. In one embodiment, the second communication protocol 108 can be a communication protocol/network utilized by positive train control systems known in the art, such as a 220 and/or 222 and/or 220-222 MHz ITCM radio network infrastructure. In another embodiment, each of the infrastructure nodes 104 can be configured to communicate with railroad assets and/or asset equipment. For example, each of the infrastructure nodes can be located within an asset house, such as a crossing house. In another embodiment, the infrastructure nodes can be within signaling houses. In another embodiment, one or more infrastructure nodes can be in communication with any type of railroad equipment configured to generate alerts.

In one embodiment, the infrastructure nodes 104 can communicate with one or more servers 114, 116 via a tower 112, such as a radio tower or any other wireless communications tower known in the art. And another embodiment, the infrastructure nodes 104 can communicate with the one or more servers 114, 116 via a cellular network, Wi-Fi, or any other suitable communications protocol. In another embodiment, the infrastructure 100 can include a plurality of additional systems 118, 120, 122, 124, and 126. for example, the additional systems can include engineering asset management (EAM) systems 118, geographical information systems (GIS) systems 120, graphical user interface (GUI) systems 122, alarm processing and transmission systems (e.g., CA Spectrum) 124, signal operations center (SOC) 126, and personnel-based systems 128. In one embodiment, the EAM system 118 can provide crossing information such as the Department of Transportation number, etc. that can be used to display correctly on the GUI 122. In another embodiment, the GIS 120 can be used to link a field location to a railroad asset on a railroad map displayed on the GUI 122. In another embodiment, the GUI 122 can enable a user to see a status of locations, define alarms, assign alarms, and see alarms all in relation to a display on a railroad map. In another embodiment, the SOC 126 can send alarms as open tickets to field personnel to request maintenance. In another embodiment, the CA Spectrum 124 can include a plurality of interconnected servers to which alarms can be sent and processed to be sent on to the SOC 126. In another embodiment, personnel 128 and/or personnel system 128 can include one or more persons involved in railroad infrastructure.

Figure 2:
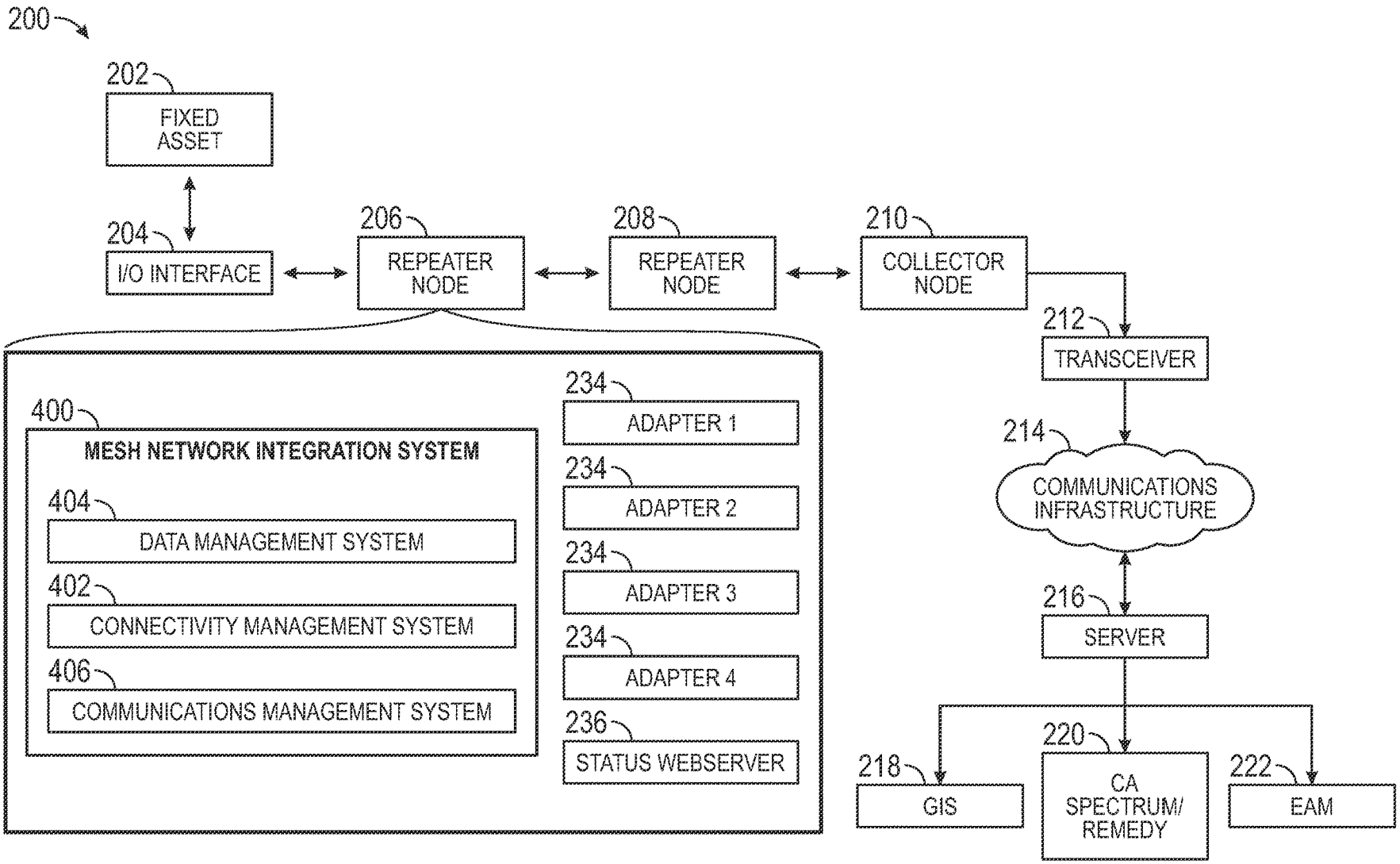
FIG. 2 illustrates a flow-chart/block diagram of railroad mesh network, in accordance with one or more exemplary embodiments of the present disclosure.

FIG. 2 illustrates a flow-chart/block diagram of railroad mesh network 200. The network 200 can include a fixed asset. For example, the fixed asset can be crossing equipment, a bridge, a signaling house, a crossing house, slide fences, high water areas, avalanche detection equipment, and/or any other equipment associated with the railroad and configured to utilize electrical signals. In one embodiment, the fixed asset 202 can be in operable communication with an input/output (I/O) interface 204. In one example, the interface 204 can be configured to receive signals from the fixed asset 202 and output those signals to, for example, an infrastructure node. In another embodiment, the network 200 can include repeater nodes 206, 208 that can be configured to receive signals from the interface 204 and/or each other. For example, the repeater nodes 206, 208 can be configured to repeat a message and/or data they receive from other repeater nodes in the network 200. In another example, the repeater nodes 206, 208 can be configured to transmit messages and/or data to other nodes in the network 200, such as collector node 210.

The collector node 210 can be similar to repeater nodes 206, 208, and be further configured to communicate with a railroad communications infrastructure 214, such as via a transceiver 212. In one embodiment, transceiver 212 can be a 220-222 MHz radio. In one embodiment, the repeater nodes 206, 208 and the collector node 210 can all be infrastructure nodes, and each of these nodes can communicate with each other via a first communications protocol. In another embodiment, the collector node 210 can be configured to communicate with the communications infrastructure 214 via a second communications protocol, such as can be enabled by the transceiver 212. In one embodiment, the collector node can be configured to collect messages and/or data from the repeater nodes 206, 208 and forward such reception to the server 216 via the communications infrastructure 214. In one embodiment, the collector node can be configured with specialized algorithms to determine that instead of repeating messages and/or data from repeater nodes, it should forward such reception onto the server 216. In another embodiment, the server 216 can be in operable communication with a plurality of other systems, such as a GIS system 218, CA spectrum system 220, and/or EAM system 222. In another embodiment, a repeater or collector node can have the same code, but can be differentiated based upon the type of connectivity available. For example, a node having cell or ITCM connectivity can become a collector, a node having LoRa connectivity can become a repeater.

In one embodiment, each of the infrastructure nodes 206, 208, 210 can be configured with any suitable hardware, firmware, and/or software to allow the nodes 206, 208, 210 to participate in the network 200. For example, each of the infrastructure nodes 206, 208, 210 can include a mesh network integration system 400. The mesh network integration system 400 can be configured with one or more systems, such as a data management system 404, connectivity management system 402, and/or a communications management system 406. In one embodiment, the nodes 206, 208, 210 implementing the mesh network integration system 400 can be configured to self-define such that hardware and/or connections available to the node on an individualistic-basis can enable the node to decide how it should act within the network 200. In another embodiment, each of the infrastructure nodes 206, 208, 210 can be configured with one or more adapters 234. The adapters 234 can enable the infrastructure nodes 206, 208, 210 and/or the mesh network integration system 400 to communicate with a plurality of constituents of the network 200. For example, an adapter 234 can be an interoperable train control system management (ITCSM) adapter configured to allow and infrastructure node to communicate with another network 200 constituent via an interoperable train control messaging (ITCM) communications protocol. In another example, two nodes can communicate via LoRa. In another example, an adapter can be a Modbus adapter configured to allow the node to communicate via Modbus and/or Modbus-TCP protocol. In another example, an adapter can be a LoRa adapter configured to enable the node to communicate via a LoRa protocol. In another embodiment, an adapter 234 can be a connectivity status adapter configured to facilitate the node's monitoring of its connections status(es). In another embodiment, the nodes 206, 208, 210 can be configured with a status webserver 236 that can enable the node to monitor metrics with respect to the node itself and/or network 200 constituents it is in operable communication with.

In one embodiment, the infrastructure nodes can be configured to communicate with each other via a LoRa protocol. In another embodiment, the LoRa data packets can include one or more of a node ID, a gateway serial number, a timestamp, a payload type code, payload specific data, payload termination character(s), a CRC, and/or a message termination character(s). In another embodiment, acknowledgement payloads can be 55 characters, heartbeat payloads can 52 characters, health payloads can be between 72 characters and 98 characters, a ping payload can be between 47 and 48 characters, GPIO—digital payload can be between 48 and 111 characters, with a minimum of 48 characters and a maximum of 111 characters, GPIO—analog can be between 53 and 200 characters, and alarms can be between 57 and 59 characters. In another embodiment, payloads can be of any suitable size and/or length to facilitate communication between infrastructure nodes, equipment, and/or other network constituents.

Figure 3:
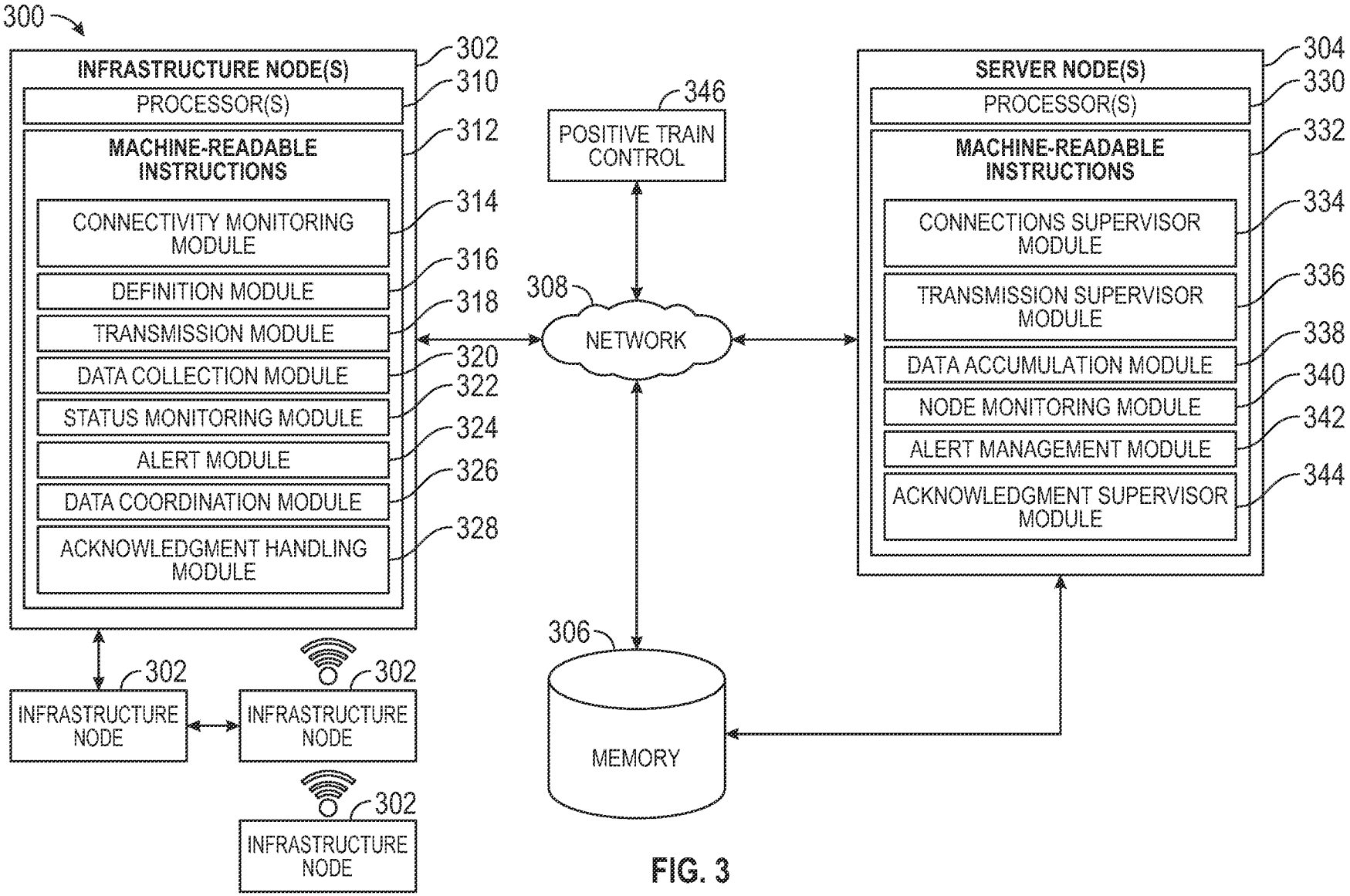
FIG. 3 illustrates a remote device monitoring system, in accordance with one or more exemplary embodiments of the present disclosure.

FIG. 3 illustrates a remote device monitoring system 300 in accordance with one or more embodiments of the present disclosure. The system 300 can include one or more infrastructure nodes 302. The nodes 302 can be operable coupled with one or more additional nodes 302 via a myriad of connection protocols and/or connection methods. The system 300 can include one or more server nodes 304 operably coupled to a database 304. The server 304 can be operably coupled to one or more nodes 302 via a network connection 308. In another embodiment, the nodes 302 and/or server 304 server 102 can be operably coupled to a positive train control (PTC) system 346, such as a PTC system like those known in the art, via the network 306. In another example, the PTC system 346 can be a networked computer 346 in operable connection with the server 304 and/or nodes 302 that is capable of receiving and/or obtaining track, vehicle, crossing house, asset, and/or maintenance data and transmitting the data to the server 304 and/or nodes 302. The system 300 can be integrated with a railroad system or railroad infrastructure to facilitate the detection of defects in railroad components, such as can be detected via infrastructure nodes 302 in operable communication with railroad assets. It will be understood by those having skill in the art that detections, captured data, measurements, determinations, alerts, etc. encompassed by the system 300 can be promulgated and/or accessible to a railroad system at large via the network 306 or other operable connection.

In one embodiment, the infrastructure node 302 can include one or more processors 310 and/or machine-readable instructions 312. In another embodiment, the server 304 can include one or more processors 330 and/or machine-readable instructions 332. In another embodiment, the node 302 and/or server 304 can access machine readable instructions 312, 332 respectively. In another embodiment, the machine-readable instructions 312 can include instructions related to a connectivity monitoring module 314, a definition module 316, a transmission module 318, a data collection module 320, a status monitoring module 322, an alert module 324, a data coordination module 326, and/or an acknowledgment handling module 328. In another embodiment, machine-readable instructions 332 can include instructions related to a connections supervisor module 334, a transmissions supervisor module 336, a data accumulation module 338, a node monitoring module 340, an alert management module 342, and/or an acknowledgment supervisor module 344.

The aforementioned system components (e.g., infrastructure node(s) 302, server(s) 304, PTC system 346, etc.) can be communicably coupled to each other via the network 308, such that data can be transmitted. The network 308 can be the Internet, intranet, or other suitable network. The data transmission can be encrypted, unencrypted, over a VPN tunnel, or other suitable communication means. The network 308 can be a WAN, LAN, PAN, LoRa, or other suitable network type. The network communication between the infrastructure nodes 302, server 304, or any other system component can be encrypted using PGP, Blowfish, Twofish, AES, 3DES, HTTPS, or other suitable encryption. The system 300 can be configured to provide communication via the various systems, components, and modules disclosed herein via an application programming interface (API), PCI, PCI-Express, ANSI-X12, Ethernet, Wi-Fi, Bluetooth, or other suitable communication protocol or medium. Additionally, third party systems and databases can be operably coupled to the system components via the network 308.

The data transmitted to and from the components of system 300 (e.g., the infrastructure nodes 302, server 304, PTC system 346, and clients), can include any format, including JavaScript Object Notation (JSON), TCP/IP, XML, HTML, ASCII, SMS, CSV, representational state transfer (REST), or other suitable format. The data transmission can include a message, flag, header, header properties, metadata, and/or a body, or be encapsulated and packetized by any suitable format having same.

One or more nodes 302 and/or server(s) 304 can be implemented in hardware, software, or a suitable combination of hardware and software therefor, and may comprise one or more software systems operating on one or more servers, having one or more processors 310, 330, with access to memory 306. Node(s) 302 and/or server(s) 304 can include electronic storage, one or more processors, and/or other components. Node(s) 302 and/or server(s) 304 can include communication lines, connections, and/or ports to enable the exchange of information via a network 308 and/or other computing platforms. Node(s) 302 and/or server(s) 304 can also include a plurality of hardware, software, and/or firmware components operating together to provide the functionality attributed herein to infrastructure node(s) 302 and/or server(s) 304. For example, infrastructure node(s) 302 and/or server(s) 304 can be implemented by a cloud of computing platforms operating together as infrastructure node(s) 302 and/or server(s) 304, including Software-as-a-Service (SaaS) and Platform-as-a-Service (PaaS) functionality. Additionally, the node(s) 302 and/or server(s) 304 can include memory 306 internally.

Memory 306 can comprise electronic storage that can include non-transitory storage media that electronically stores information. The electronic storage media of electronic storage can include one or both of system storage that can be provided integrally (e.g., substantially non-removable) with node(s) 302 and/or server(s) 304 and/or removable storage that can be removably connectable to node(s) 302 and/or server(s) 304 via, for example, a port (e.g., a USB port, a firewire port, etc.) or a drive (e.g., a disk drive, etc.). Electronic storage may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage may include one or more virtual storage resources (e.g., cloud storage, a virtual private network, and/or other virtual storage resources). The electronic storage can include a database, or public or private distributed ledger (e.g., blockchain). Electronic storage can store machine-readable instructions 312, 332, software algorithms, control logic, data generated by processor(s), data received from server(s), data received from computing platform(s), and/or other data that can enable server(s) to function as described herein. The electronic storage can also include third-party databases accessible via the network 308.

Processor(s) 310, 330 can be configured to provide data processing capabilities in node(s) 302 and/or server(s) 304, respectively. As such, processor(s) 310, 330 can include one or more of a digital processor, an analog processor, a digital circuit designed to process information, an analog circuit designed to process information, a state machine, and/or other mechanisms for electronically processing information, such as FPGAs or ASICs. The processor(s) 310, 330 can be a single entity or include a plurality of processing units. These processing units can be physically located within the same device, or processor(s) 310, 330 can represent processing functionality of a plurality of devices or software functionality operating alone, or in concert.

The processor(s) 310, 330 can be configured to execute machine-readable instructions 312, 332 or machine learning modules via software, hardware, firmware, some combination of software, hardware, and/or firmware, and/or other mechanisms for configuring processing capabilities on processor(s) 310, 330. As used herein, the term "machine-readable instructions" can refer to any component or set of components that perform the functionality attributed to the machine-readable instructions component 312, 330. This can include one or more physical processors 310, 330 during execution of processor-readable instructions, the processor-readable instructions, circuitry, hardware, storage media, or any other components.

The node(s) 302 and/or server(s) 304 can be configured with machine-readable instructions 312, 332 having one or more functional modules. The machine-readable instructions 312, 330 can be implemented on one or more node(s) 302 and/or server(s) 304, having one or more processors 310, 330, with access to memory 306. The machine-readable instructions 312, 332 can be a single networked node, or a machine cluster, which can include a distributed architecture of a plurality of networked nodes. The machine-readable instructions 312, 332 can include control logic for implementing various functionality, as described in more detail below. The machine-readable instructions 312, 332 can include certain functionality associated with the remote device monitoring system 300. Additionally, the machine-readable instructions 312, 332 can include a smart contract or multi-signature contract that can process, read, and write data to a database, distributed ledger, or blockchain.

Figure 4:
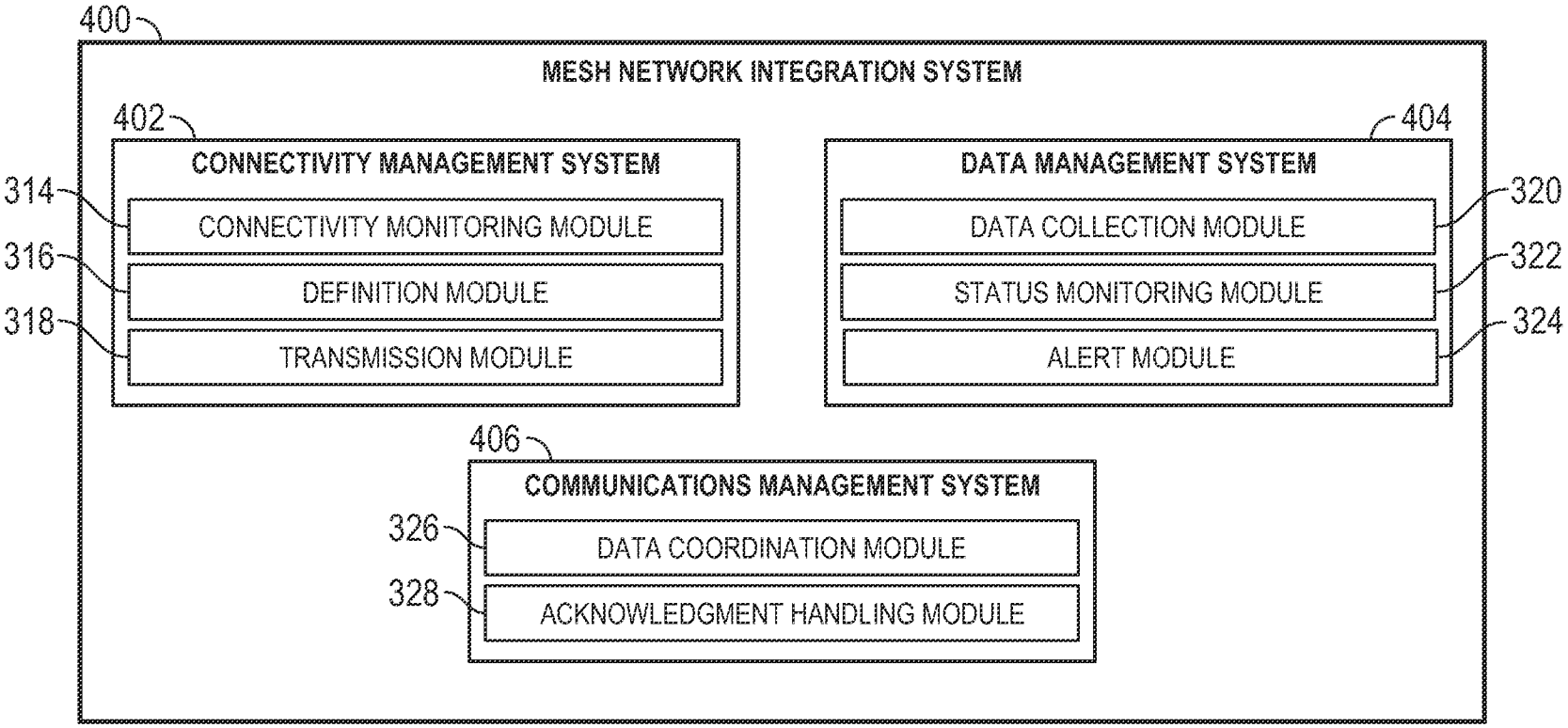
FIG. 4 illustrates a schematic view of a mesh network integration system, in accordance with one or more exemplary embodiments of the present disclosure.

FIG. 4 illustrates a schematic view of a mesh network integration system 400, in accordance with one or more exemplary embodiments of the present disclosure. System 400 can include a connectivity management system 402, a data management system 404, and/or a communications management system 406. In one embodiment, the mesh network integration system 400 can be implemented on an infrastructure node in accordance with the principles of the present disclosure.

In one exemplary embodiment, the connectivity management system 402 can include a connectivity monitoring module 314, a definition module 316, and/or a transmission module 318. In one embodiment, the connectivity monitoring module 314 can be configured to capture data from an infrastructure node on which it is implemented regarding the available and/or configured connections on a given infrastructure node, and further define a node's role in a network/infrastructure/system (e.g., infrastructure 100, network 200, system 300, etc.) and transmit messages/data throughout a system based on captured data. For example, and in one embodiment, the connectivity monitoring module 314 can continuously check configured connections on a given infrastructure node. For example, the connectivity monitoring module 314 can check for adapters, drivers, wired connections, or any other suitable indicators of connections on a node. In another example, the connectivity monitoring module 314 can determine which connections are configured for the infrastructure node to utilize. In another example, the connectivity monitoring module 314 can further determine whether configured connection protocols are available. For example, an infrastructure node can be configured with two separate connection types, but only one of which could be available, such as due to reception, faulty wiring, inability to handshake, or any other malfunction or other event that could cause a connection to not be available while still configured for the device to use.

In another exemplary embodiment, the definition module 316 can be configured to communicate with the connectivity monitoring module 314 to receive data related to the configured and/or available connections. In another embodiment, the definition module 316 can be configured to define an infrastructure node's role in a given infrastructure/network/system. For example, the definition module 316 can determine that if a particular connection type is not configured on the node, then the node should act as a first type of node, such as a repeater node. In one embodiment, the definition module 316 can determine that because a particular connection type is not configured on the node, that the node should therefore have a particular role in a given infrastructure/network/system. In another embodiment, the definition module 316 can determine that if a particular connection type is configured for an infrastructure node, the infrastructure node should act as a second type of node, such as a collector node. In this manner, and as one example, the definition module 316 can utilize data captured by the connectivity monitoring module 314 to define a node within a network. In another embodiment, the definition module 316 can determine that if a particular connection type is not configured for a particular node, that node does not have the capability to communicate via such connection type and should therefore only communicate via a second or other connection type. In another embodiment, the definition module 316 can determine that if a particular connection type is configured on an infrastructure node, the infrastructures nodes first role should be to utilize such particular configured connection type and should only utilize a different connection type if such connection type is unavailable.

In another exemplary embodiment, the transmission module 318 of the connectivity management system 402 can be configured to transmit messages and/or data throughout a given infrastructure/network/system. For example, the transmission module 318 can be in operable communication with the connectivity monitoring module 314 and/or the definition module 316. In one embodiment, the transmission module 318 can utilize data provided by the connectivity monitoring module 314 and/or the definition module 316 to determine how to transmit a given message and/or data. For example, the transmission module 318 can determine via the connectivity monitoring module 314 which connections are configured on a given infrastructure node. In another embodiment, based on this information, transmission module 318 can prioritize a communication protocol by which to transmit information. In another embodiment, the transmission module 318 can determine via the definition module 316 how the infrastructure node is defined within a given infrastructure/network/system and prioritize how information is transmitted based on such definition. In another embodiment, the transmission module 318 can include a configured connection hierarchy such that the transmission module 318 can decide to transmit information via the available and/or configured connection with the highest priority, and if such connection is unavailable and/or not configured, the transmission module 318 can decide to use the available and/or configured connection with the next highest priority. In another embodiment, the transmission module 318 can be configured to packetize data via any suitable protocol in accordance with the principles of present disclosure.

In one exemplary embodiment, the data management system 404 can include a data collection module 320, a status monitoring module 322, and/or an alert module 324. In one embodiment, the data collection module 320 can be configured to receive data from the connectivity management system 402 and/or the communications management system 406. In another embodiment, the data collection module 320 can be configured to capture data via coupled sensors and/or other components suitable to capture data. In another embodiment, data collection module 320 can be configured to receive data, such as from and input/output module. In another embodiment, the data collection module 320 can be configured to receive data from a railroad asset. In one example, the data collection module 320 can be configured to receive data from equipment associated with, for example, a crossing and/or crossing house of a railroad track. In another embodiment, the data collection module 320 can be configured to perform processing on received data, such as to determine the intended destination of received data. In another embodiment, the data collection module 320 can be configured to process and/or analyze a payload of a data packet and determine if payload-specific processing should be performed. In another embodiment, the data collection module 320 can be configured to receive data from another infrastructure node. For example, the data collection module 320 can be in operable communication with another infrastructure node such that the other infrastructure node can direct data to the data collection module 320. In one embodiment, the data collection module 320 can receive data packets from other infrastructure nodes it is in operable communication with and perform any suitable processing on such packets to assist the mesh network integration system 400 to determine what to do with the data packet.

In one exemplary embodiment, the status monitoring module 322 can be configured to monitor and/or transmit the status of an infrastructure node implementing the data management system 404 and/or mesh network integration system 400. For example, the status monitoring module 322 can be configured to implement one or more timers within control logic to periodically transmit a health, heartbeat, location, or any other information relevant to the status of an infrastructure node. In another embodiment, the status monitoring module can utilize the transmission module 318 of the connectivity management system 402 to properly transmit status data throughout a given infrastructure/network/system. In one embodiment, a heartbeat generated by the status monitoring module 322 can include an indication to one or more nodes and/or servers that the given infrastructure node is integrated with the network. In another embodiment, health data and/or health of the infrastructure node generated by the status monitoring module 322 can include a myriad of data related to the health over the infrastructure node, including connection status, connection strength, temperature, humidity, memory usage, battery life, and/or any other data related to the infrastructure node. In another embodiment, the status monitoring module 322 can generate a location and transmit such location along with the heartbeat and/or health and or other data, such as to indicate to one or more nodes and/or servers the location of the infrastructure node that is transmitting such information.

In another exemplary embodiment, the alert module 324 can be configured to generate and/or receive alerts within a given infrastructure or network or system. For example, the alert module 324 can be in operable communication with the data collection module 320 and can read data collected by the data collection module 320 to determine whether an alert should be generated. For example, the data collection module 320 can be configured to receive electrical signals from, for example, equipment, such as crossing equipment. The data collection module 320 can communicate with the alert module 324 such that the alert module 324 can determine whether such electrical signals indicate that an alert should be generated. For example, the alert module 324 can compare such signals to an alert threshold and determine whether such alert threshold is satisfied. In one embodiment, if the alert threshold is satisfied, the alert module 324 can generate an alert. In another embodiment, the alert module 324 can receive indications and/or data from one or more infrastructure nodes on the network and determine whether such received information and/or data satisfies an alert threshold.

In one exemplary embodiment, the communications management system 406 can include a data coordination module 326 and/or an acknowledgment handling module 328. For example, the data coordination module 326 can be configured two direct data and/or data packets throughout the network and/or mesh network integration system 400. For example, the data coordination module 326 can be configured to process and/or analyze a packet, including a header and/or a payload, to determine where a data packet should be processed. For example, the data coordination module 326 can be configured to determine whether a data packet received by a node implementing the mesh network integration system 400 is the processing destination for the packet and thereby coordinate processing of the data packet within the mesh network integration system 400 implemented on a given infrastructure node. In another example, the data coordination module 326 can be configured to determine that an infrastructure node implementing the mesh network integration system 400 is not the destination for processing for a particular data packet and thereby coordinate the transmittal and/order transference of a data packet to another destination within the network.

In another embodiment, the acknowledgment handling module 328 can be configured to generate acknowledgments that can be transmitted to other nodes within the network. For example, the acknowledgment handling module 328 can be configured to generate acknowledgments indicating that one or more data packets have been received from another node in the network. In another embodiment, the acknowledgment handling module 328 can be configured to determine whether a particular data packet or other transmission requires an acknowledgment. In one example, if the packet requires acknowledgement, the acknowledgment handling module 328 can generate an acknowledgment. In another example, if the packet does not require an acknowledgement, the acknowledgment handling module 328 can determine that no acknowledgement need be generated. In another example, the acknowledgment handling module 328 can be in operable communication with one or more infrastructure nodes and/or server nodes. In one embodiment, the acknowledgment handling module 328 can be further configured to request acknowledgements from other nodes in the network. For example, the acknowledgment handling module 328 can be configured to communicate with the connectivity management system 402 and/or data management system 404 to generate data packets indicating an acknowledgment requirement or lack thereof. For example, the acknowledgment handling module 328 can be configured to determine, based on the type of data being packetized, whether an acknowledgment requests need be incorporated into the data packet. For example, if the data management system 404 via the alert module 324 instantiates alert generation and eventual transmission, the acknowledgment handling module 328, being in reception of a generated alert, can determine that the alert requires an acknowledgement of reception by another node in the network, and can further generate such acknowledgement request for packetization with the alert packet.

Figure 5:
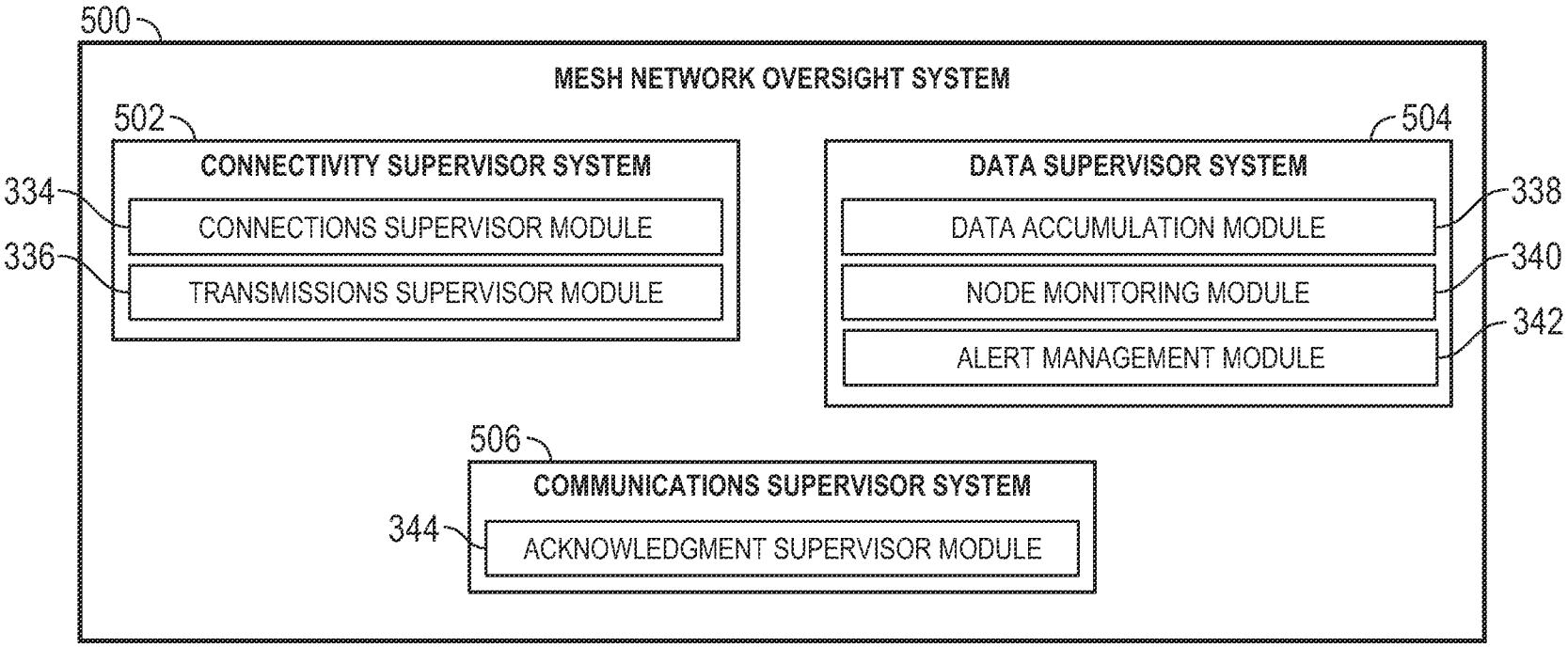
FIG. 5 illustrates a schematic view of a mesh network oversight system, in accordance with one or more exemplary embodiments of the present disclosure.

FIG. 5 illustrates a schematic view of a mesh network oversight system 500, in accordance with one or more exemplary embodiments of the present disclosure. System 500 can include a connectivity supervisor system 502, a data supervisor system 504, and/or a communications supervisor system 506. In one embodiment, the mesh network oversight system 500 can be implemented on a server node in accordance with one or more principles of the present disclosure.

In one exemplary embodiment, the connectivity supervisor system 502 can include a connection supervisor module 334 and/or transmissions at supervisor module 336. In one example, the connections supervisor module 334 can be configured to capture data from a server node on which it is implemented regarding the available and/or configured connections on a given server node and transmit messages/data throughout a system based on captured data. For example, and in one embodiment, the connections supervisor module 334 can continuously check configured connections on a given server node. For example, the connections supervisor module 334 can check for adapters, drivers, wired connections, or any other suitable indicators of connections on a node. In another example, the connections supervisor module 334 can determine which connections are configured for the server node to utilize. In another example, the connections supervisor module 334 can further determine whether configured connection protocols are available. For example, a server node can be configured with one or more separate connection types, but only one of which could be available, such as due to reception, faulty wiring, inability to handshake, or any other malfunction or other event that could cause a connection to not be available while still configured for the device to use.

In another exemplary embodiment, the transmissions supervisor module 336 of the connectivity supervisor system 502 can be configured to transmit messages and/or data throughout a given infrastructure/network/system. For example, the transmissions supervisor module 336 can be in operable communication with the connections supervisor module 334. In one embodiment, the transmissions supervisor module 336 can utilize data provided by the connections supervisor module 334 to determine how to transmit a given message and/or data. For example, the transmissions supervisor module 336 can determine via the connections supervisor module 334 which connections are configured on a given server node. In another embodiment, based on this information, transmissions supervisor module 336 can prioritize a communication protocol by which to transmit information. In another embodiment, the transmissions supervisor module 336 can include a configured connection hierarchy such that the transmissions supervisor module 336 can decide to transmit information via the available and/or configured connection with the highest priority, and if such connection is unavailable and/or not configured, the transmissions supervisor module 336 can decide to use the available and/or configured connection with the next highest priority. In another embodiment, the transmissions supervisor module 336 can be configured to packetize data via any suitable protocol in accordance with the principles of present disclosure.

In one exemplary embodiment, the data supervisor system can include a data accumulation module 338, a node monitoring module 340, and/or an alert management module 342. In one embodiment, the data supervisor system 504 can be in operable communication with the connectivity supervisor system 502 and/or of the communications supervisor system 506. In one example, the data accumulation module 338 can be configured to receive data and/or data packets from one or more infrastructure nodes in operable communication with the mesh network oversight system 500. In another example, the data accumulation module 338 can accumulate such data from the infrastructure nodes and facilitate the storage of such data in a usable format, such as on a per node basis. In another embodiment, the data accumulation module 338 can facilitate be further processing and/or transmission of data from a plurality of infrastructure nodes to other components in the network. In another embodiment, the data accumulation module 338 can be configured to collect data from collector nodes on the network.

In another exemplary embodiment, the node monitoring module 340 can be configured to communicate with one or more infrastructure nodes in a network. For example, the node monitoring module 340 can be configured to receive data related to node health and/or node status and/or node heartbeat. In another embodiment, the node monitoring module 340 can be configured to periodically request status checks of one or more nodes on the network. For example, the node monitoring module 340 can be configured to implement one or more timers within control logic to periodically request a health, heartbeat, location, or any other information relevant to the status of one or more infrastructure nodes. In another embodiment, the node monitoring module 340 can utilize the transmissions supervisor module 336 of the connections supervisor system 502 to properly transmit status data throughout a given infrastructure/network/system. In another embodiment, the node monitoring module 340 can be configured to compare data received from infrastructure nodes on the network with health and/or status thresholds, such that the node monitoring module 340 can determine whether a node needs attention or not.

In one exemplary embodiment, the alert management module 342 can be configured to manage alerts within the network. For example, the alert management module 342 can be configured to receive alerts from one or more infrastructure nodes and/or mesh network integration systems 400 on the network. In one embodiment, the alert management module 342 can be configured to communicate with the transmissions supervisor module 336 to direct an alert originally generated by an infrastructure node to a proper system with which the mesh network oversight system 500 is in operable communication with. In another embodiment, the alert management module 342 can be configured to compare data received from one or more infrastructure nodes with one or more alert thresholds to determine whether a data packet received from an infrastructure node should be considered an alert. In another embodiment, the alert management module 342 can be configured two contact different systems in operable communication with the mesh network oversight system 500 depending on a type of alert received from one or more infrastructure nodes.

In another exemplary embodiment, the communications supervisor system 506 can include an acknowledgment supervisor module 344. In one embodiment, the communications supervisor system 506 can be configured to communicate with the connectivity supervisor system 502 and the data supervisor system 504. In one example, the acknowledgment supervisor module 344 can be configured to check whether data packets received from one or more infrastructure nodes require acknowledgement. In another example, the acknowledgment supervisor module 344 can be configured to generate acknowledgements for such data packets requiring acknowledgement. In another embodiment, the acknowledgment supervisor module 344 can be configured to request acknowledgements, such as if transmitting information to one or more infrastructure nodes on the network, and such as if such information transmitted requires acknowledgement of perception. In another embodiment, the acknowledgment supervisor module 344 can be configured to periodically check the network for outstanding acknowledgement requests and generate such acknowledgements, if appropriate, or utilize the transmissions supervisor module 336 to contact one or more systems on the network to draw attention to the outstanding acknowledgement request. In another embodiment, the acknowledgment supervisor module 344 can be configured to generate acknowledgement requests for other systems to which the mesh network oversight system 500 has transmitted alerts. For example, the acknowledgment supervisor module 344 can be configured to request acknowledgements for alert transmissions such that the mesh network oversight system 500 can receive confirmation that an alert have been received.

Figure 6:
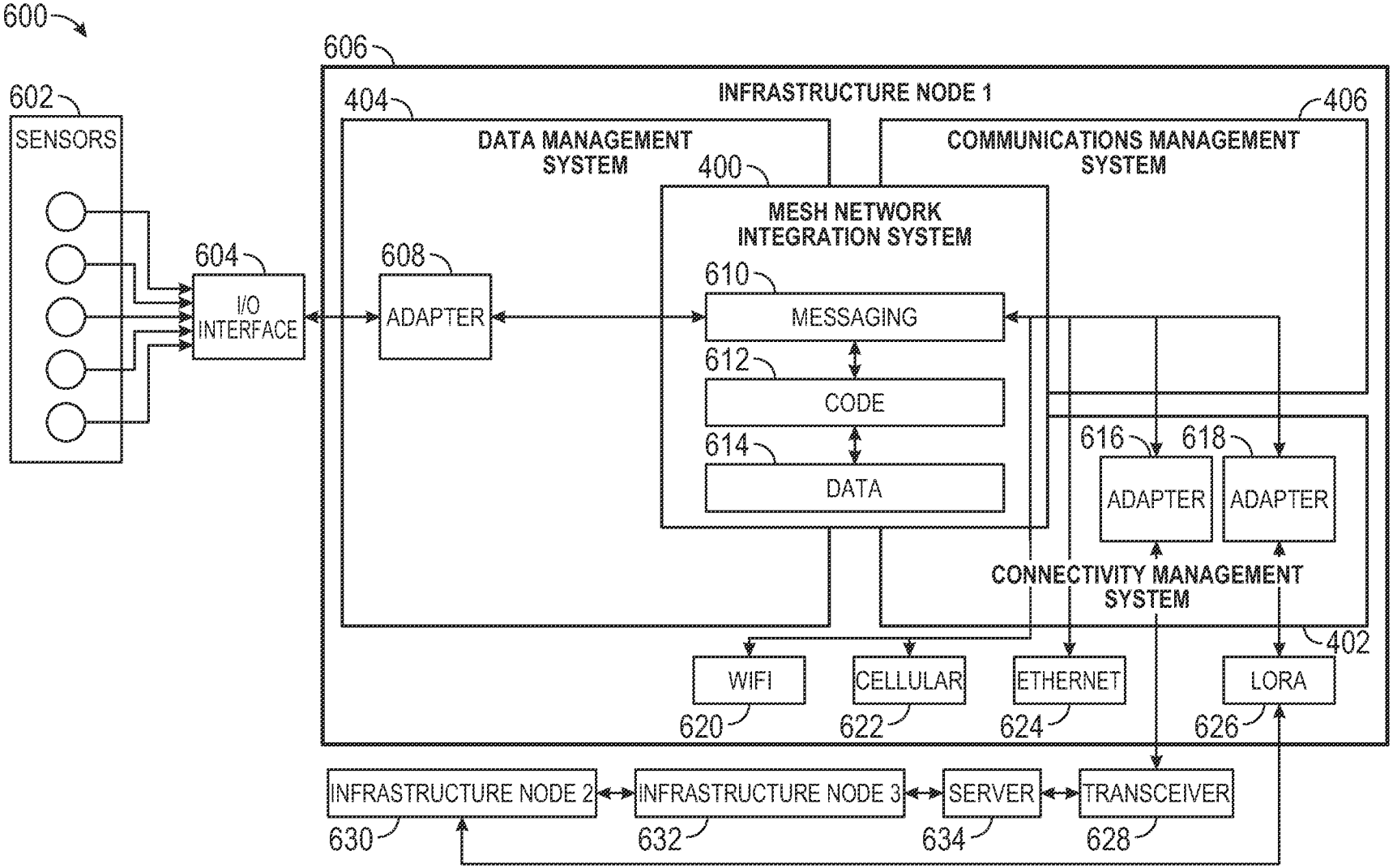
FIG. 6 illustrates a block diagram of a railroad network, in accordance with one or more exemplary embodiments of the present disclosure.

FIG. 6 depicts a block diagram of a railroad network 600 in accordance with one or more embodiments of the present disclosure. The network 600 can include one or more sensors 602 that can be related to one or more asset locations. For example, these sensors can be located proximate railroad crossings and/or can be related to operation of railroad crossing equipment. In another embodiment, the sensors 602 can be related and/or integrated with any other railroad assets, such as assets located proximate a railroad track, or proximate waysides and/or can be related to operation of railroad wayside equipment. In another embodiment, the network 600 can include and input/output interface 604. For example, the interface 604 can be configured to receive signals from the sensors 602. In another embodiment, the interface 604 can be configured to receive signals from the sensors 602 and communicate such signals to, for example, an infrastructure node, such as infrastructure node one 606.

In another embodiment, the network 600 can include a first infrastructure node 606. For example, the infrastructure node 606 can include a data management system 404, a communications management system 406, and/or a connectivity management system 402, in accordance with the principles of the present disclosure. In one embodiment, the first infrastructure node 606 can communicate with the sensors 602 and/or interface 604 via and adapter 608. In one embodiment, adapter 608 can be considered to fall within the purview of the data management system, such that the data management system 404 can receive data from railroad assets. In another embodiment, the first infrastructure node 606 can include a mesh network integration system 400. In one embodiment, the mesh network integration system 400, connectivity management system 402, data management system 404, and communications management system 406 can facilitate particular aspects of the mesh network integration system 400 and/or internal operations and communications of the first infrastructure node 606. For example, the infrastructure node 606 can include messaging constituent 610, code constituent 612 (such as machine readable instructions), and data constituent 614. In another embodiment, the mesh network integration system 400 can implement and/or communicate with the connectivity management system 402, data management system 404, and/or communications management system 406. In another embodiment, messaging 610, code 612, and data 614 can be considered as overarching aspects of the mesh network integration system 400 overlapping with each of the connectivity management system 402, data management system 404, and/or communications management system 406.

In another embodiment, messaging constituent 610 facilitated by the mesh network integration system 400 can further facilitate communication of the first infrastructure node 606 with other network nodes. For example, the messaging constituent 610 of the mesh network integration system 400 can communicate via adapters 616, 618 and/or an Ethernet connection 624. In one embodiment, adapters 616, 618, falling within the purview of the connectivity management system 402, can enable communication via one or more communication protocols. For example, adapter 616 can facilitate connection with a transceiver 628, such as a PTC transceiver, that can facilitate communication of the infrastructure node 606 with the server 634. In another embodiment, adapter 618 can facilitate connection with a wireless communications protocol (e.g., LoRa protocol) that can facilitate communication of the first infrastructure node 606 with a second infrastructure node 630. In another embodiment, messaging 610 of the mesh network integration system 400 can communicate directly with an Ethernet connection 624 such that another system in operable communication with the Ethernet connection 624 can receive data from the messaging constituent 610 of the mesh network integration system 400. In another embodiment, the second infrastructure node 630 can act as a repeater node, receiving a transmission from the first infrastructure node 606 and repeating such transmission to infrastructure node three 632. In one embodiment, the third infrastructure node 632 can act as a collector node, receiving these transmissions from infrastructure nodes one 606 and two 630 and transmitting such received data to the server 634.

Figure 7:
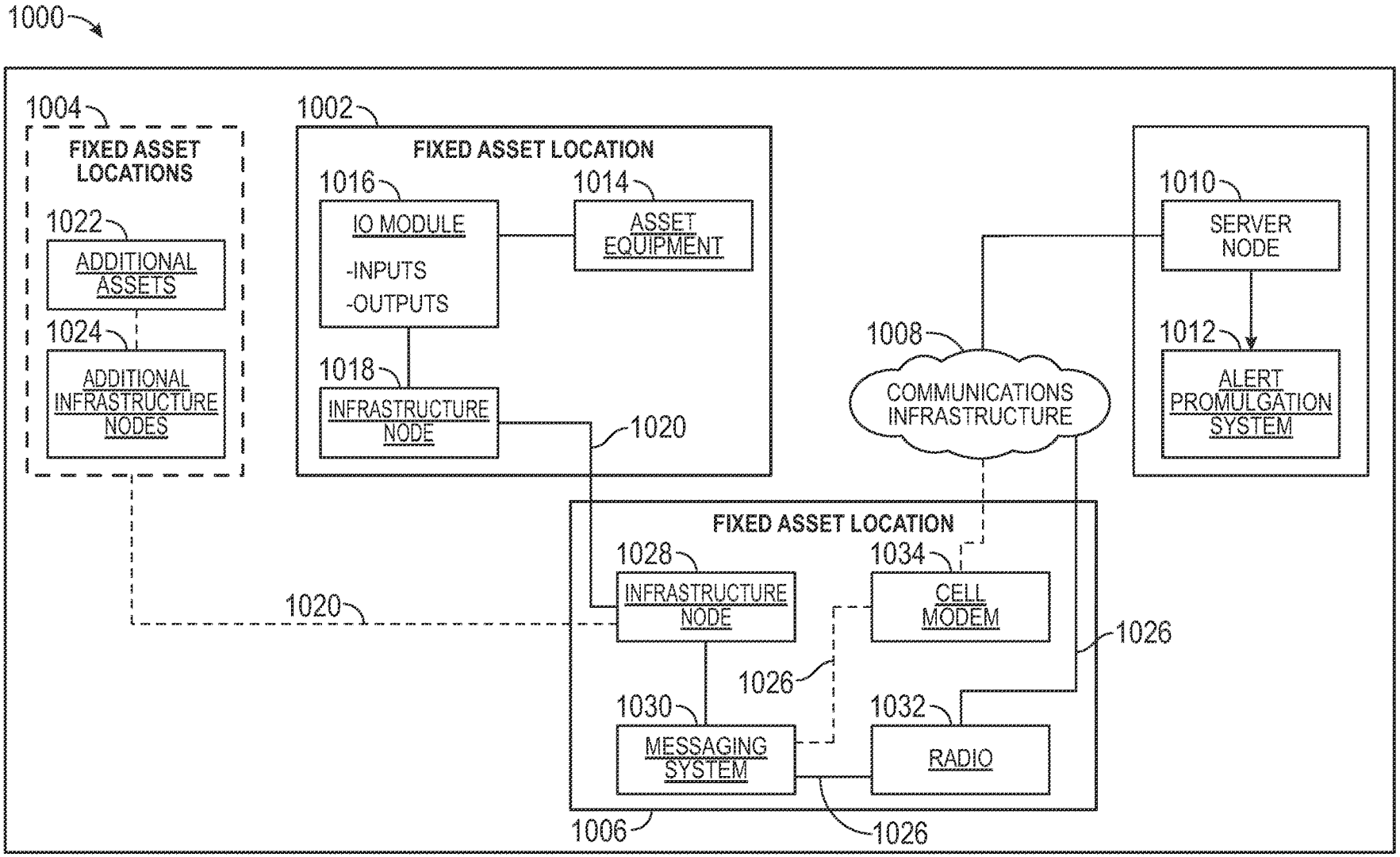
FIG. 7 depicts a block diagram of a railroad communications network, in accordance with one or more exemplary embodiments of the present disclosure.

FIG. 7 depicts a block diagram 1000 of a railroad communications network 1000. In one embodiment, the communications network can include one or more fixed asset locations 1002, 1004. In one embodiment, fixed asset location 1002 and/or 1004 can be a crossing house. In one embodiment, the locations 1002, 1004 can be in operable communication with another fixed asset location 1006. In one embodiment, asset location 1006 can be a signaling house. In another embodiment, fixed asset location 1006 can further be in communication with the communications infrastructure 1008 that can facilitate communication of the fixed asset location 1006 with, for example, a server node 1010. In another embodiment, the server node 1010 can be in operable communication with an alert promulgation system 1012.

In another embodiment, fixed asset location 1002 can be any other fixed asset location in a railroad infrastructure. In one embodiment, the fixed asset location 1002 can include asset equipment 1014. For example, asset equipment 1014 can include crossing equipment or any other equipment relevant to a railroad that utilizes electrical signals. In another embodiment, the fixed asset location 1002 can include and input/output module. For example, the asset equipment 1014 can be in operable communication with the I/O module, such that the I/O module can receive input from the asset equipment 1014 and output such information to an infrastructure node 1018. In one body meant, the infrastructure node 1018 can be an infrastructure node in accordance with the principles of the present disclosure. In another embodiment, fixed asset locations 1004 can be similar to fixed asset location 1002, including additional assets 1022 and/or asset equipment 1022, I/O modules, and/or infrastructure nodes 1024.

In one embodiment, the infrastructure node 1018 can be in operable communication with another infrastructure node 1028 that can be located at fixed asset location 1006. In one embodiment, infrastructure node 1018 and infrastructure node 1028 can communicate via a first communication protocol 1020. For example, protocol 1020 can include transmissions at a particular frequency. For example, the frequency of the communication protocol 1020 can be 900 megahertz. In another embodiment, protocol 1020 can be a LoRa protocol. In another embodiment, communication protocol 1020 can include any suitable protocol to enable the infrastructure nodes 1018, 1028 to communicate. In another embodiment, infrastructure node 1028 can communicate with other network constituents via another communication protocol 1026. In one embodiment, protocol 1026 can be a ITCM protocol. In another embodiment, communication protocol 1026 can include any suitable protocol to enable the infrastructure node 1028 to communicate with equipment at the asset location 1006. In another embodiment, the fixed asset location 1006 can include a messaging system 1030, such as a messaging system known in the art. In one embodiment, the messaging system can facilitate communication of information collected by the infrastructure node 1028 with the radio 1032 and/or cell modem 1034, and ultimately with the server 1010. In one embodiment, the infrastructure node 1028 can communicate with the messaging system 1030 via an MQTT protocol.

In another embodiment, the radio 1032 and/or the cell modem 1034 can each have a certain prioritization with respect to how the fixed asset location 1006 transmits information and/or messages. For example, if the radio is configured and available, the radio can be a first priority connection. In another embodiment, if the radio 1032 is not available, the fixed asset location 1006 can instead use the cell modem 1034 to communicate in the network. In another embodiment, the radio 1032 and/or cell modem 1034 can be in any other order of priority. In another embodiment, communications infrastructure 1008 can include radio infrastructure or any other infrastructure utilized by railroad. For example, the communications infrastructure 1008 can be a communications infrastructure commonly utilized by a positive train control system, such as a 220 and/or 222 and/or 220-222 megahertz ITCM communications infrastructure. In another embodiment, the server node 1010 can receive information from the fixed asset location 1006 via the communications infrastructure 1008 and forward such information and/or alerts or other data packets derived from such information to an alert promulgation system 1012. In one embodiment, the alert promulgation system 1012 can include a ticketing system, such as a ticketing system used to manage wayside alarms and/or crossing alarms.

Figure 8A:
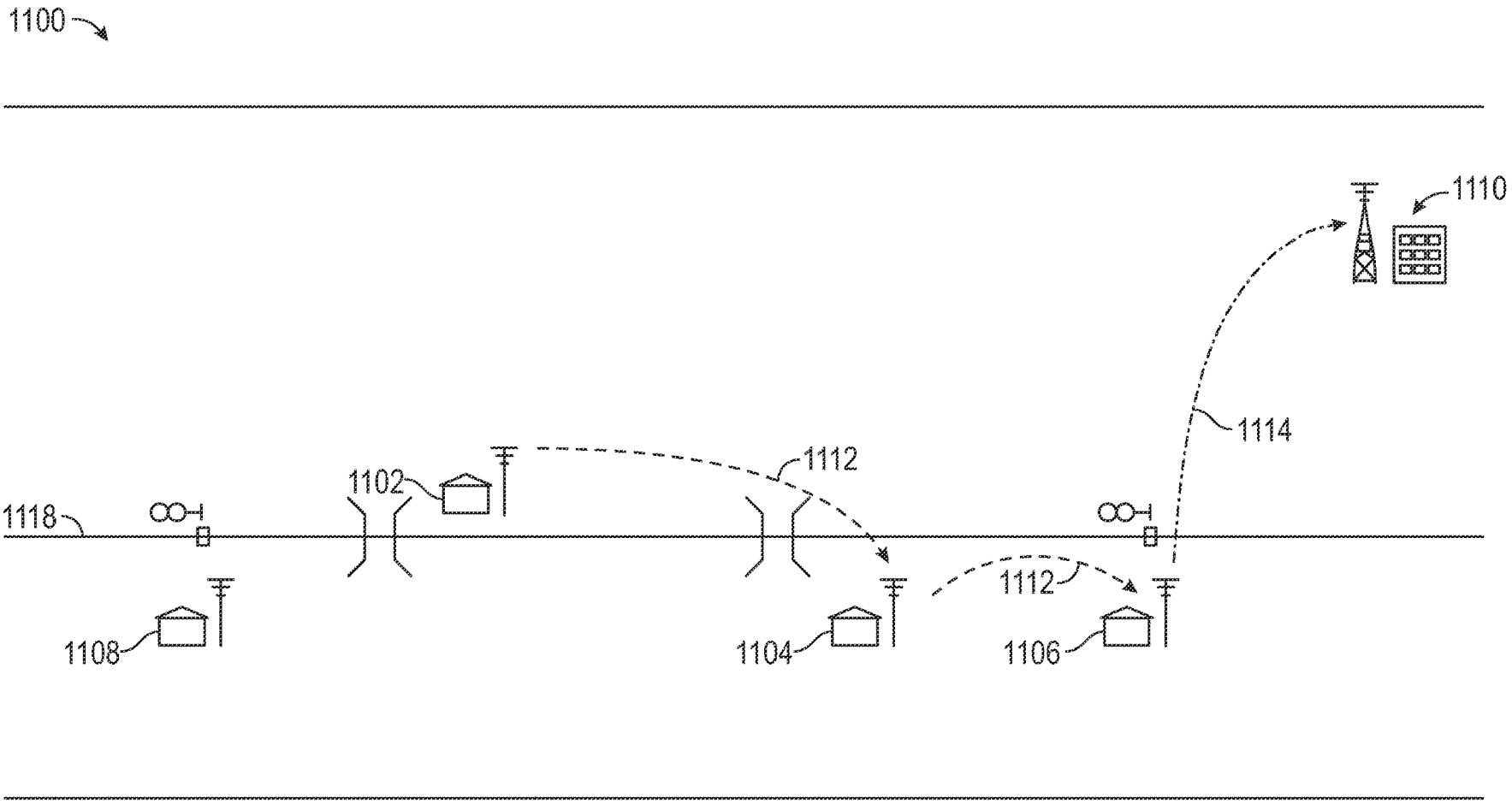
FIGS. 8A-8B illustrate a railroad signaling system, in accordance with one or more exemplary embodiments of the present disclosure.
Figure 8B:
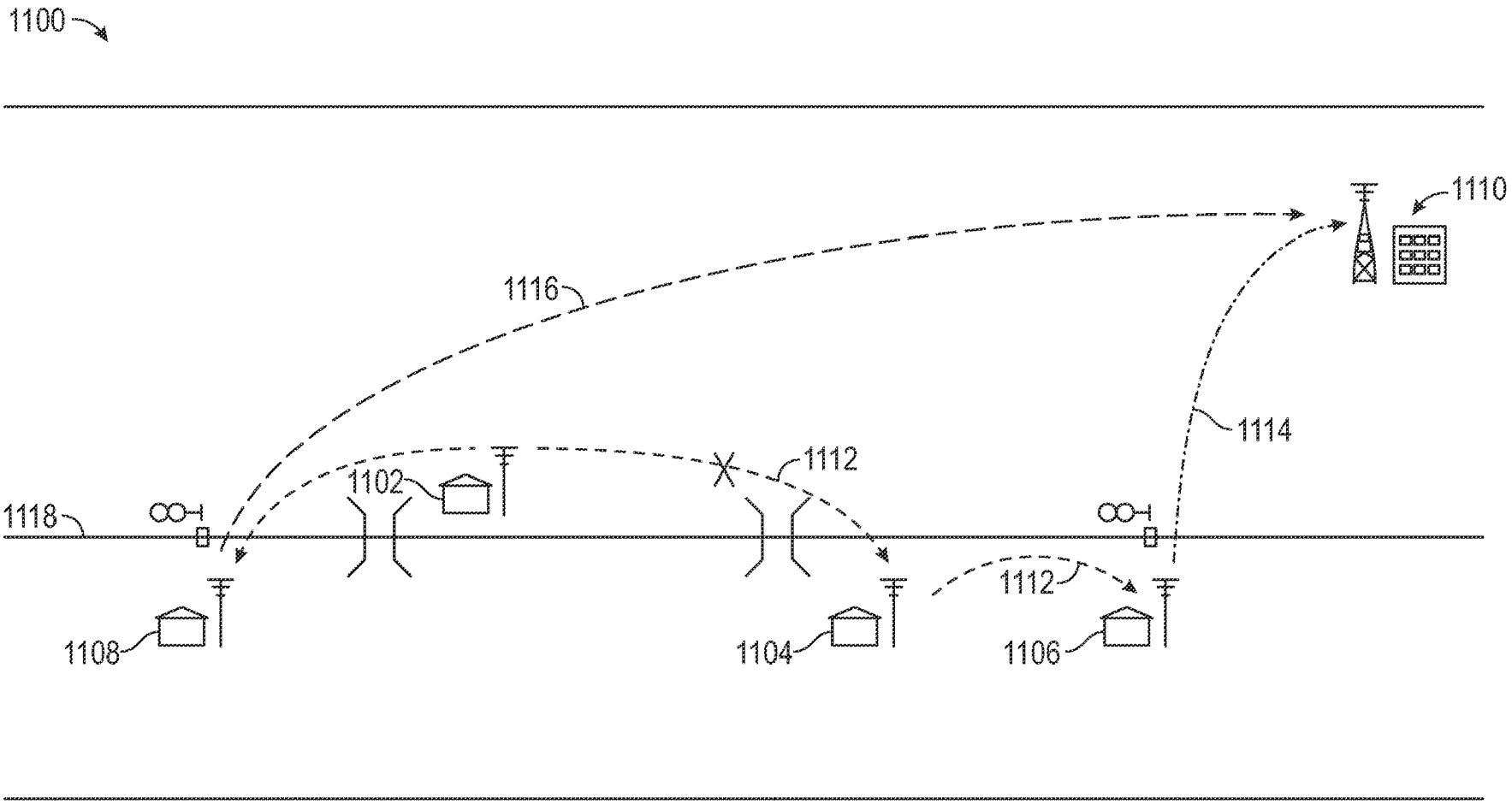

FIGS. 8A-8B illustrate a railroad signaling system 1100 in accordance with the principles of the present disclosure. The system 1100 can include a plurality of infrastructure nodes 1102, 1102, 1106, 1108 positioned proximate a railroad track 1118, and/or a server 1110. In one embodiment, each of the infrastructure nodes 1102, 1102, 1106, 1108 can communicate with one another via a first communication protocol 1112. For example, the first communication protocol 1112 can be a LoRa protocol, or any other suitable communications protocol. In another embodiment, at least one of the infrastructure nodes 1102, 1102, 1106, 1108 can be configured to utilize a second communications protocol 1114 to communicate with the server 1110. In one embodiment, the second communications protocol 1114 can facilitate a longer range than the first communications protocol 1112. In another embodiment, if communication between one or more infrastructure nodes is obstructed, such as can be seen in FIG. 8B with respect to infrastructure nodes 1102 and 1104, the system 1100 can be configured to find another way to transmit information to the server 1110. For example, another infrastructure node can be configured to utilize a third communications protocol 1116 to forward information to the server if another connection in the network is obstructed. In another embodiment, the communications protocol 1116 can be similar to or the same as communications protocol 1114.

Figure 9:
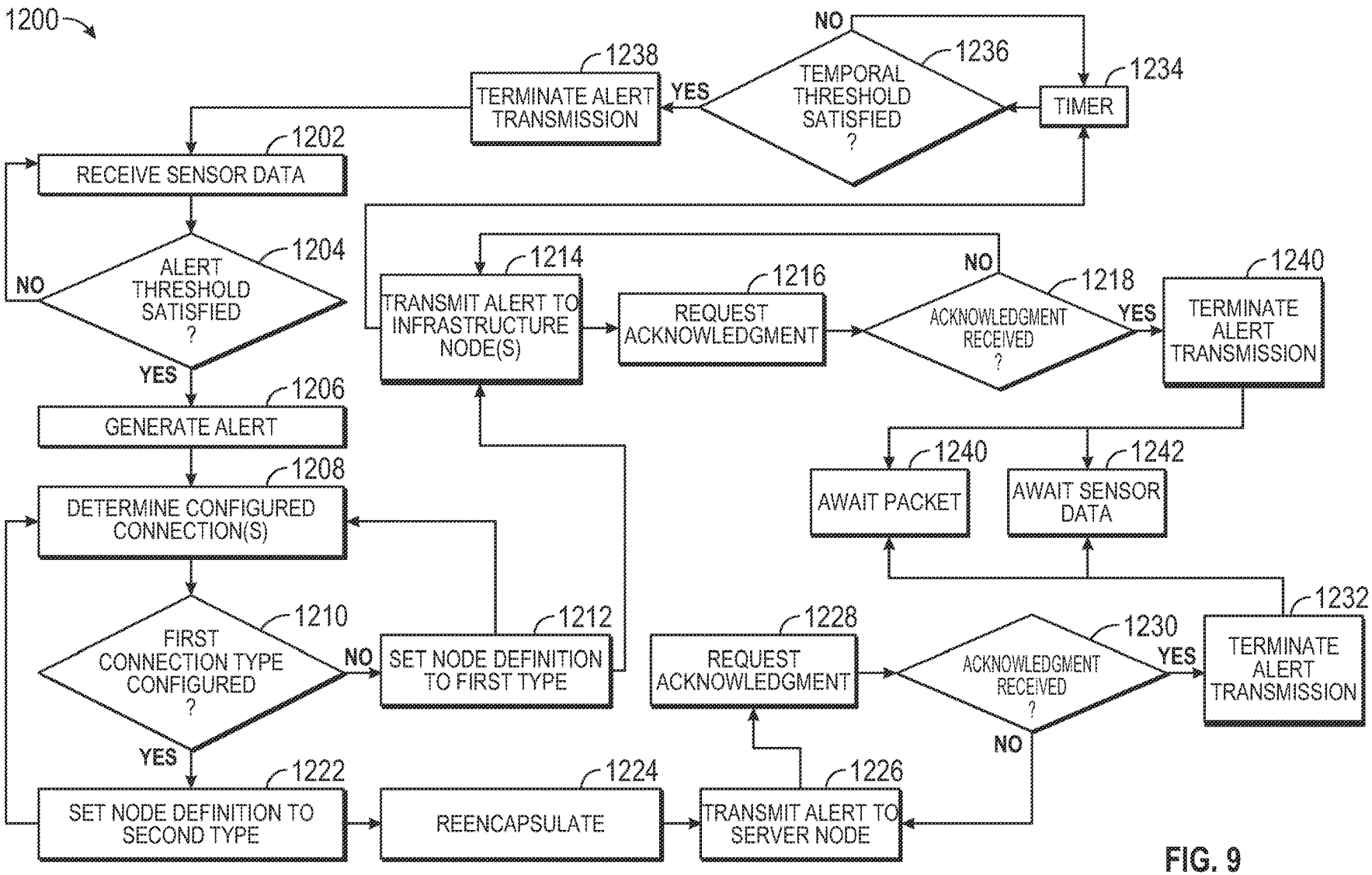
FIG. 9 illustrate a flow chart of a node integration system, in accordance with one or more exemplary embodiments of the present disclosure.

FIG. 9 illustrates a flow chart diagram 1200 exemplifying control logic embodying features of a node integration system 1200, in accordance with an exemplary embodiment of the present disclosure. The node integration logic 1200 can be implemented as an algorithm on a node (e.g., infrastructure node 302), a machine learning module, or other suitable system. Additionally, the node integration control logic 1200 can implement or incorporate one or more features of the mesh network integration system 400, including the connectivity management system 402, the data management system 404, and/or the communications management system 406. The node integration control logic 1200 can be achieved with software, hardware, an application programming interface (API), a network connection, a network transfer protocol, HTML, DHTML, JavaScript, Dojo, Ruby, Rails, other suitable applications, or a suitable combination thereof.

The node integration control logic 1200 can leverage the ability of a computer platform to spawn multiple processes and threads by processing data simultaneously. The speed and efficiency of the node integration control logic 1200 is greatly improved by instantiating more than one process to facilitate personnel safety. However, one skilled in the art of programming will appreciate that use of a single processing thread may also be utilized and is within the scope of the present disclosure.

The node integration control logic 1200 process flow of the present embodiment begins at step 1202, wherein the control logic 1200 receives sensor data. In one embodiment, the control logic 1200 can receive sensor data, such as from crossing equipment or other railroad equipment. In another embodiment, the control logic 1200 can receive temperature data, force data, motion data, or any other data collected by a sensor. The control logic 1200 then proceeds to step 1204.

At step 1204, the control logic 1200 can determine whether an alert threshold is satisfied. For example, the control logic 1200 can compare the sensor data received at step 1202 with alert thresholds available to the control logic 1200 and determine whether the sensor data received satisfies one or more alert thresholds. For example, and an alert threshold can include current modulations, current negations, or any other indications or irregularity that can be perceived and/or communicated by one or more sensors. If the control logic 1200 determines that the alert threshold is not satisfied, the control logic 1200 then proceeds back to step 1202. If the control logic 1200 determines that the alert threshold is satisfied, the control logic 1200 then proceeds to step 1206.

At step 1206, the control logic 1200 can generate an alert. For example, the control logic 1200 can generate an alert indicating that sensor data was received that satisfied the alert threshold. For example, the control logic 1200 can generate it alert indicating that a crossing equipment has malfunctioned. In another embodiment, the control logic 1200 can generate an alert the train has malfunctioned on the tracks. In another embodiment, the control logic 1200 can generate any alert suitable to notify railroad infrastructure and/or systems and/or personnel that an event has occurred. The control logic then proceeds to step 1208.

At step 1208, the control logic 1200 can determine configured connections. For example, the control logic 1200 can determine which connections are configured on a device implementing the control logic 1200, such as an infrastructure node. In another example, the control logic 1200 can iterate through its connection list to determine which connections are configured. The control logic 1200 then proceeds to step 1210.

At step 1210, the control logic 1200 can determine whether a first connection type is configured. For example, the control logic 1200 can determine if the connections determined at step 1208 include a first connection type. In one embodiment, the first connection type can be a 220-megahertz connection type. In another embodiment, the first connection type can be any connection type suitable to communicate with a PTC infrastructure. In another embodiment, the first connection type can be any connection type suitable to communicate. If the control logic 1200 determines that the first connection type is not configured, the control logic 1200 then proceeds to step 1212. If you control logic determines that the first connection type is configured, the control logic 1200 then proceeds to step 1222.

At step 1212, the control logic 1200 can set a node definition to a first type. In one embodiment, a first type of node definition can be a repeater node. For example, a repeater node can be configured to receive correspondence from one or more infrastructure nodes in a network and continue to forward such correspondence on until a node is reached with the first connection type configured. In another embodiment, the first node type can be any node without the first connection type configured. The control logic 1200 then proceeds back to step 1208 to continue to determine configured connections and to step 1214.

At step 1214, the control logic 1200 can transmit an alert to one or more infrastructure nodes in the network. For example, the control logic 1200 can create a duplicate of the data received, and/or re-packetized data for transmission to one or more infrastructure nodes. In one embodiment, the control logic 1200 can transmit the alert to infrastructure nodes via a second communications protocol. In one embodiment, the second communications protocol can be a LoRa protocol. In another embodiment, the second communications protocol can be a 900-megahertz protocol. In another embodiment, the second communications protocol can be any communication protocol suitable to allow the control object 1200 to communicate with one or more infrastructure nodes in the network. The control logic 1200 then proceeds to step 1216 and step 1234.

At step 1216, the control logic 1200 can request acknowledgement. For example, the control logic 1200 can transmit an acknowledgement request throughout the network. The control logic 1200 in proceeds to step 1218.

At step 1218, the control logic 1200 can determine whether an acknowledgement was received. For example, the control logic 1200 can receive weather the acknowledgment requested at step 1216 has been received. If the control logic 1200 determines that an acknowledgment was not received, the control logic 1200 then proceeds back to step 1214. If the control logic determines that an acknowledgment was received, the control logic 1200 then proceeds to step 1240.

At step 1240, the control logic 1200 can terminate transmission of the alert. For example, the control logic 1200 can determine that the alert was received because the alert was acknowledged, and therefore determined that the alert transmission should be terminated. The control logic 1200 then proceeds to step 1240 and 1242.

At step 1240, the control logic 1240 can await a packet. For example, the control logic 1200 can be prepared to receive a new data packet, such as a packet from and infrastructure node in the network. In another embodiment, the control logic 1200 can await a packet from one or more servers or network constituents. The control logic 1200 can then terminate or repeat any of the aforementioned steps.

At step 1242, the control logic 1200 can await sensor data. For example, the control logic 1200 can be prepared to receive additional sensor data, such as to compare the sensor data with alert thresholds in accordance with the principles of the present disclosure. The control logic 1200 can then terminate or repeat any of the aforementioned steps.

At step 1234, the control logic can instantiate a timer. The control logic 1200 then proceeds to step 1236.

At step 1236, the control logic 1200 can determine if a temporal threshold has been satisfied. For example, the control logic 1200 can utilize the timer instantiated in step 1234 to determine how long an alert has been transmitted. If the control logic 1200 determines that the temporal threshold has not been satisfied, the control logic 1200 then proceeds back to step 1234 to receive time data from the timer. If the control logic 1200 determines the temporal threshold has been satisfied, the control logic then proceed step 1238.

At step 1238, control logic 1200 can terminate an alert transmission. For example, the control logic 1200 can determine that an alert has been transmitting for long enough that the control logic 1200 should recheck sensor data to ensure that the alert condition is still occurring and has not been fixed. The control logic 1200 then proceeds to step 1202.

At step 1222, the control logic 1200 can set a node definition to a second type. In one embodiment, a second type of node can be a collector node. For example, a collector node can be configured to receive transmissions from one or more infrastructure nodes and forward such transmissions to a server node connected to the network. In another embodiment, a second type of node can be any node with the first connection type configured. The control logic 1200 then proceeds to step 1224.

At step 1224, the control logic 1200 can re-encapsulate the data and/or an alert generated. For example, the control logic 1200 can re-encapsulate a message such that it can be transferred via the first configured connection type. In another embodiment, the control logic 1200 can re-encapsulate the alert and/or data and any suitable manner to transmit the alert and/forward data throughout the network. The control logic 1200 then proceeds to step 1226.

At step 1226, the control logic 1200 can transmit the alert to a server node. For example, the control logic 1200 can determine that it is a second type of node because the first connection type was configured, and after re-encapsulating the data at step 1224, the packetized data can be suitable for transmission to the server node. The control logic 1200 then proceeds to step 1228.

At step 1228, the control lock at 1200 can request acknowledgement. For example, the control logic 1200 can request acknowledgment from the server node to confirm that the server node received the transmission. In another embodiment, the control logic 1200 can request acknowledgment from any other node in the network suitable to acknowledge receipt of the alert. The control logic 1200 then proceeds to step 1230.

At step 1230, the control logic 1200 can determine whether an acknowledgment has been received. For example, the control logic 1200 can determine whether the acknowledgement requested at step 1228 has been received. If the control logic 1200 determines the acknowledgment was not received, the control logic 1200 then proceeds back to step 1226 to continue to transmit the alert to the server node. If the control logic 1200 determines that the acknowledgement was received, the control logic 1200 then proceeds to step 1232.

At step 1232, the control logic 1200 can terminate transmission of the alert. For example, the control logic 1200 can determine that because transmission of the alert was acknowledged, that the alert transmission should be terminated. The control logic 1200 then proceeds to steps 1240 and 1242.

Figure 10:
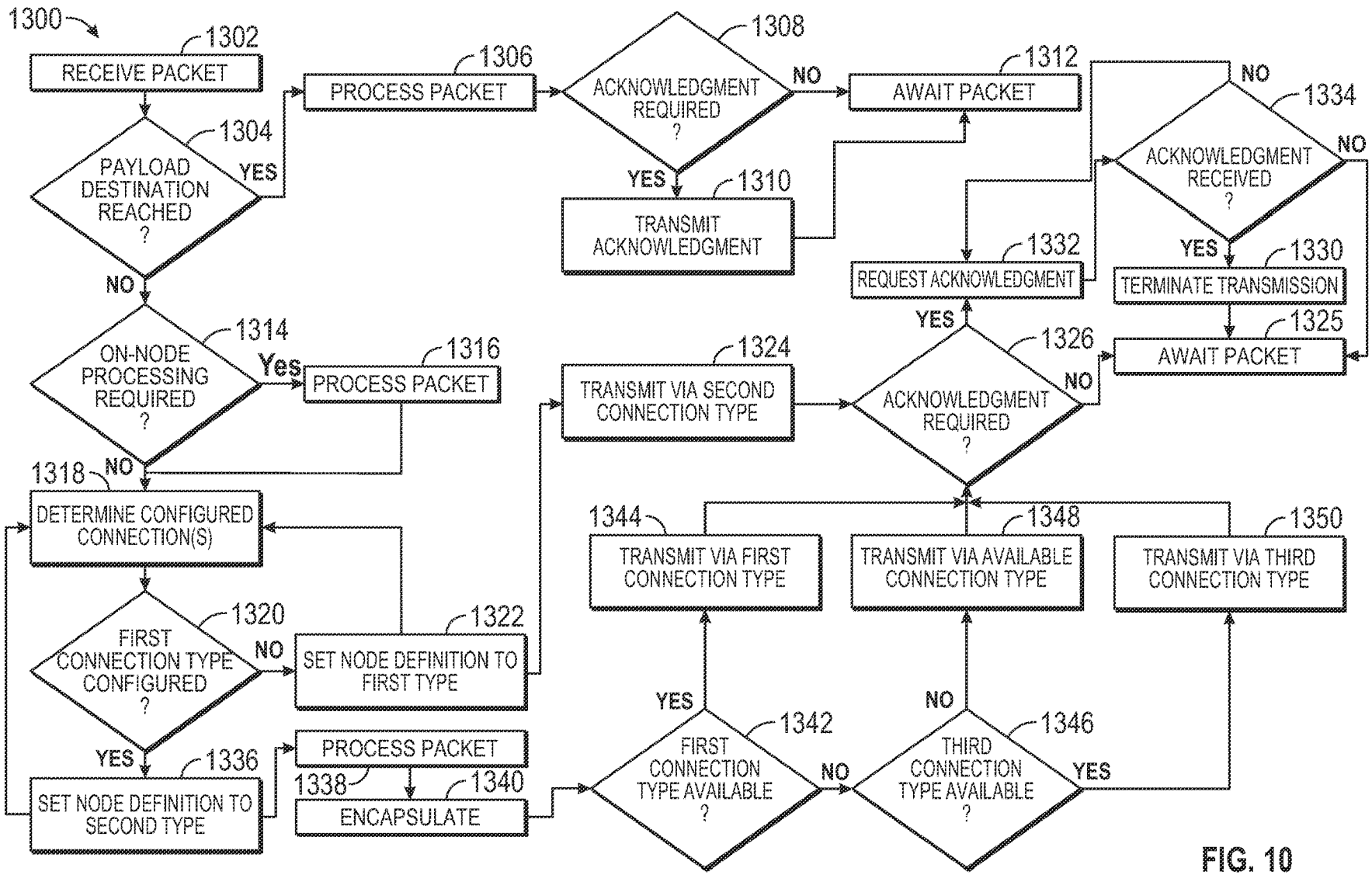
FIG. 10 illustrate a flow chart of a data coordination system, in accordance with one or more exemplary embodiments of the present disclosure.

FIG. 10 illustrates a flow chart diagram 1300 exemplifying control logic embodying features of a data coordination system 1300, in accordance with an exemplary embodiment of the present disclosure. The data coordination logic 1300 can be implemented as an algorithm on a node (e.g., infrastructure node 302), a machine learning module, or other suitable system. Additionally, the data coordination control logic 1300 can implement or incorporate one or more features of the mesh network integration system 400, including the connectivity management system 402, the data management system 404, and/or the communications management system 406. The data coordination control logic 1300 can be achieved with software, hardware, an application programming interface (API), a network connection, a network transfer protocol, HTML, DHTML, JavaScript, Dojo, Ruby, Rails, other suitable applications, or a suitable combination thereof.

The data coordination control logic 1300 can leverage the ability of a computer platform to spawn multiple processes and threads by processing data simultaneously. The speed and efficiency of the data coordination control logic 1300 is greatly improved by instantiating more than one process to facilitate personnel safety. However, one skilled in the art of programming will appreciate that use of a single processing thread may also be utilized and is within the scope of the present disclosure.

The data coordination control logic 1300 process flow of the present embodiment begins at step 1302, wherein the control logic 1300 receives a packet. In one embodiment, the packet can be from an infrastructure node. In another embodiment, the packet can be a data packet. In another embodiment, the packet can include a header, a payload, ID/gateway serial number, a timestamp, a payload type code, payload specific data, a cyclic redundancy check (CRC), and/or a message. The control logic 1300 then proceeds to step 1304.

At step 1304, the control logic 1300 can determine whether the payload destination was reached. For example, the control logic 1300 can analyze the data packet received in step 1302 and determine whether the indicated destination is itself or not. If the control logic 1300 determines that the payload destination has been reached, the control logic 1300 then proceeds to step 1306. If the control logic 1300 determines that the payload destination has not been reached, the control logic 1300 then proceeds to step 1314.

At 1306, the control logic 1300 can process the packet. For example, the control logic 1300 can unpack the packet to analyze the payload. In another embodiment, the control logic 1300 can perform any other processing suitable to glean data from the data packet and/or enable the control logic 1300 to determine what the data packet is communicating. The control logic 1300 then proceeds to step 1308.

At step 1308, the control logic 1300 can determine whether the data packet requires an acknowledgment. For example, the data packet can require an acknowledgment. If the control logic 1300 determines that acknowledgement is required, the control logic 1300 then proceeds to step 1310. If the control logic 1300 determines that acknowledgement is not required, the control logic 1300 then proceeds to step 1312.

At step 1310, the control logic 1300 can transmit an acknowledgement. For example, the control logic 1300 can generate an acknowledgment and transmit the acknowledgement throughout the network, such that the originator of the packet can receive the acknowledgement and sees transmittal of the packet. The control logic 1300 then proceeds to step 1312.

At step 1312, the control logic 1300 can await a data packet. For example, the control logic 1300 can be prepared to receive another data packet. The control logic 1300 can then terminate or repeat any of the aforementioned steps.

At step 1314, the control logic 1300 can determine whether on-node processing is required. For example, the data packet received in step 1302 can indicate that further processing on a receiving node should be performed. In one embodiment, the control logic 1300 can determine whether a data packet needs to be processed further in order to maximize bandwidth efficiency. If the control logic 1300 determines that on-node processing is required, the control logic 1300 then proceeds to step 1316. If the control logic 1300 determines that on-node processing is not required, the control logic 1300 then proceeds to step 1318.

At step 1316, the control logic 1300 can process the packet. For example, the control logic 1300 can unpack the packet to analyze the payload. In another embodiment, the control logic 1300 can perform any other processing suitable to glean data from the data packet and/or enable the control logic 1300 to determine what the data packet is communicating. The control logic 1300 then proceeds to step 1318.

At step 1318, the control logic 1300 can determine configured connections. For example, the control logic 1300 can determine which connections are configured on a device implementing the control logic 1300, such as an infrastructure node. In another example, the control logic 1300 can iterate through its connection list to determine which connections are configured. The control logic 1300 then proceeds to step 1320.

At step 1320, the control logic 1300 can determine whether a first connection type is configured. For example, the control logic 1300 can determine if the connections determined at step 1318 include a first connection type. In one embodiment, the first connection type can be a 220-megahertz connection type. In another embodiment, the first connection type can be any connection type suitable to communicate with a PTC infrastructure. In another embodiment, the first connection type can be any connection type suitable to communicate. If the control logic 1300 determines that the first connection type is not configured, the control logic 1300 then proceeds to step 1322. If you control logic determines that the first connection type is configured, the control logic 1300 then proceeds to step 1336.

At step 1322, the control logic 1300 can set a node definition to a first type. In one embodiment, a first type of node definition can be a repeater node. For example, a repeater node can be configured to receive correspondence from one or more infrastructure nodes in a network and continue to forward such correspondence on until a node is reached with the first connection type configured. In another embodiment, the first node type can be any node without the first connection type configured. The control logic 1300 then proceeds back to step 1318 to continue to determine configured connections and to step 1324.

At step 1324, the control logic 1300 can transmit via a second connection type. For example, the control logic 1300 can determine that because the first connection type is not configured, the control logic 1300 should transmit via the second connection type. In another embodiment, the control logic 1300 can transmit a data packet, a signal, and alert, or any other information via the second connection type. In one embodiment, the second connection type can be a LoRa connection. The control logic 1300 then proceeds to step 1326.

At step 1326, the control logic 1300 can determine whether acknowledgement is required. For example, the control logic 1300 can determine whether the packet received in step 1302 requires reception acknowledgement. If the control logic determines that acknowledgement is required, the control logic 1300 then proceeds to step 1332. If the control logic 1300 determines that an acknowledgement is not required, the control logic 1300 then proceeds to step 1325.

At step 1332, the control logic 1300 can request an acknowledgment. For example, the control logic 1300 can determine that an acknowledgement is required for the packet received step 1302, and the control logic 1300 can repeat the packet throughout the network along with an acknowledgement request. The control logic 1300 then proceeds to step 1334.

At step 1334, the control logic 1300 can determine whether an acknowledgment has been received. For example, the control logic 1300 can be configured to await and acknowledgement from another constituent of the network after transmitting the packet. If the control logic 1300 determines that an acknowledgement was not received, the control logic 1300 then proceeds back to step 1332 and to step 1325. If the control logic 1300 determines that acknowledgement was received, the control logic 1300 then proceeds to step 1330.

At step 1330, the control logic 1300 can terminate transmission of the packet. For example, the control logic 1300 can determine that acknowledgement was received and therefore determined that transmission of the packet should be terminated. The control logic 1300 then proceeds to step 1325.

At step 1336, the control logic 1300 can set a node definition to a second type. In one embodiment, a second type of node can be a collector node. For example, a collector node can be configured to receive transmissions from one or more infrastructure nodes and forward such transmissions to a server node connected to the network. In another embodiment, a second type of node can be any node with the first connection type configured. The control logic 1300 then proceeds to step 1338.

At step 1338, the control logic 1300 can process the packet. For example, the control logic 1300 can unpack the packet to analyze the payload. In another embodiment, the control logic 1300 can perform any other processing suitable to glean data from the data packet and/or enable the control logic 1300 to determine what the data packet is communicating. The control logic 1300 then proceeds to step 1340.

At step 1340, the control logic 1300 can encapsulate. For example, the control logic 1300 can utilize the data from the processed packet and encapsulate such data such that the data can be retransmitted in a new data packet. In one embodiment, the encapsulated data can include a header, a payload, gateway serial number, timestamp, or any other fields suitable for a data packet. The control logic then proceeds to step 1342.

At step 1342, the control logic 1300 can determine whether the first connection type is available. For example, the first connection type can be configured on the infrastructure node, but can nevertheless be unavailable, such as do to malfunction, lack of reception, etc. If the control logic 1300 determines that the first connection type is available, the control logic 1300 then proceeds to step 1344. If the control logic determines that the first connection type is not available, the control logic 1300 then proceed to step 1346.

At step 1344, the control logic 1300 can transmit via a first connection type. For example, the control logic 1300 can transmit the data encapsulated at step 1340 via the first connection type. In one embodiment, the first connection type can be a 220 and/or 222 and/or 220-222 megahertz connection. In another embodiment, the first connection type can be any connection type suitable to communicate with a PTC communications infrastructure. The control logic 1300 then proceeds to step 1326.

At step 1346, the control logic 1300 can determine whether a third connection type is available. For example, the control logic 1300 can determine that because the first connection type is not available, it should then determine whether the third connection type is available. In one embodiment, the third connection type can be a cellular data connection. In another embodiment, the third connection type can be any connection suitable to enable the infrastructure node and/or control logic 1300 to communicate with one or more constituents of a network. If the control logic 1300 determines that the third connection type is available, the control logic 1300 then proceeds to step 1350. If the control logic 1300 determines that the third connection type is not available, the control logic then proceeds to step 1348.

At step 1350, the control logic 1300 can transmit via the third connection type. For example, the control logic 1300 can transmit the data encapsulated at step 1340 via the third connection type. The control logic then proceeds to step 1326.

At step 1348, the control logic 1300 can transmit via an available connection type. For example, the control logic 1300 can determine that the first and third connection types of unavailable and should therefore transmit via the next available connection type. The control logic 1300 then proceeds to step 1326.

At step 1325, the control logic 1300 can await a data packet. For example, the control logic 1300 can be prepared to receive another data packet. The control logic 1300 can then terminate or repeat any of the aforementioned steps.

Figure 11:
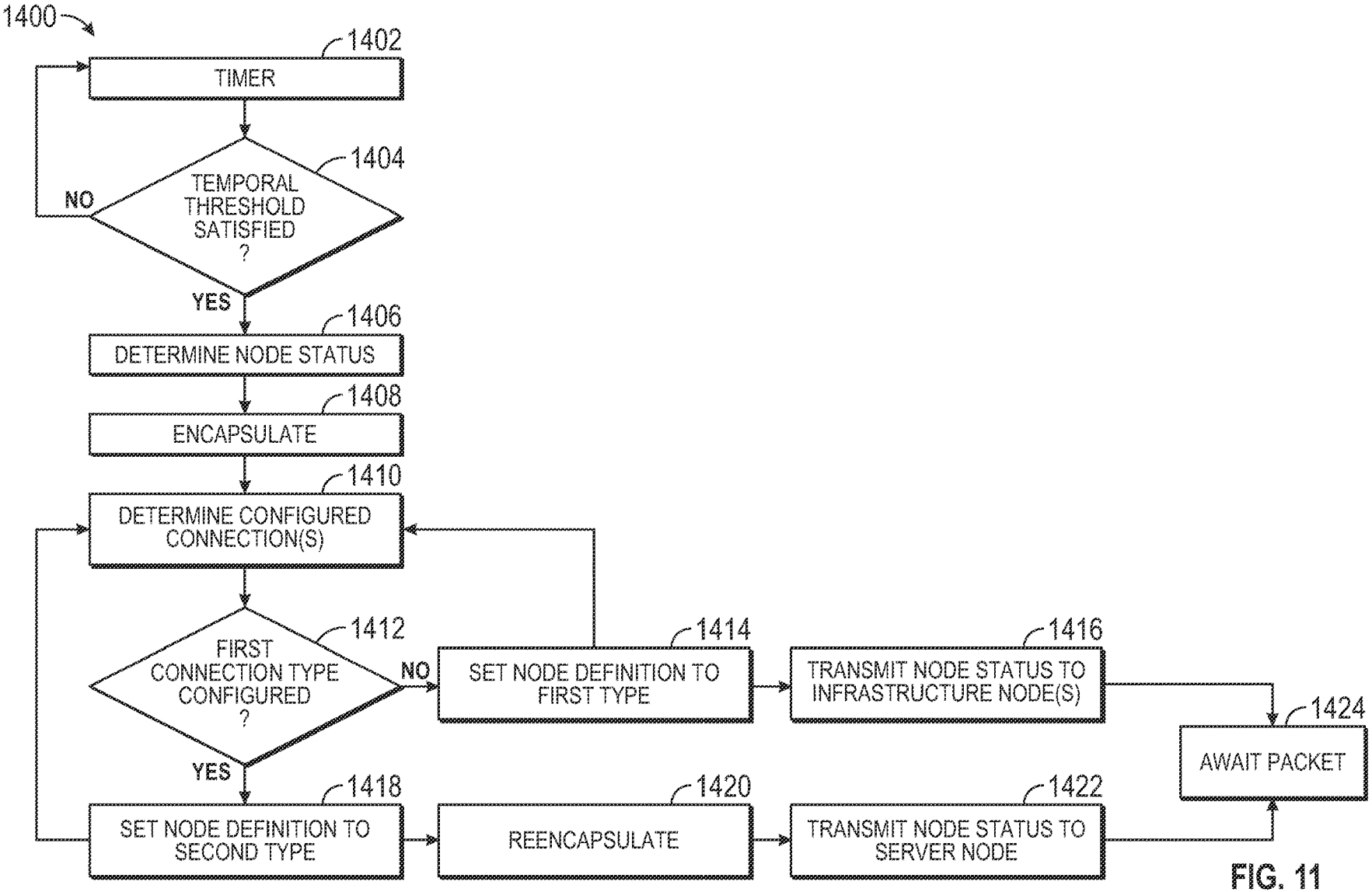
FIG. 11 illustrate a flow chart of a node status system, in accordance with one or more exemplary embodiments of the present disclosure.

FIG. 11 illustrates a flow chart diagram 1400 exemplifying control logic embodying features of a node status system 1400, in accordance with an exemplary embodiment of the present disclosure. The node status logic 1400 can be implemented as an algorithm on a node (e.g., infrastructure node 302), a machine learning module, or other suitable system. Additionally, the node status control logic 1400 can implement or incorporate one or more features of the mesh network integration system 400, including the connectivity management system 402, the data management system 404, and/or the communications management system 406. The node status control logic 1400 can be achieved with software, hardware, an application programming interface (API), a network connection, a network transfer protocol, HTML, DHTML, JavaScript, Dojo, Ruby, Rails, other suitable applications, or a suitable combination thereof.

The node status control logic 1400 can leverage the ability of a computer platform to spawn multiple processes and threads by processing data simultaneously. The speed and efficiency of the node status control logic 1400 is greatly improved by instantiating more than one process to facilitate personnel safety. However, one skilled in the art of programming will appreciate that use of a single processing thread may also be utilized and is within the scope of the present disclosure.

The data coordination control logic 1400 process flow of the present embodiment begins at step 1402, wherein the control logic 1400 instantiates a timer. For example, the timer can countdown from a particular value and generate a value and forward or and instruction when the countdown is completed. In another embodiment, the timer can be a clock. In another embodiment, the timer can be any suitable temporal measurement instruction and/or function. The control logic 1400 then proceeds to step 1404.

At step 1404, the control logic 1400 can determine if a temporal threshold has been satisfied. For example, if the timer counts down to zero, the control logic 1400 can determine that the temporal threshold has been satisfied. In another embodiment, if the timer reaches a particular time of day, the control logic could determine that the temporal threshold has been satisfied. If the control logic 1400 determines that the temporal threshold has not been satisfied, the control logic then proceeds back to step 1402. If the control logic determines that the temporal threshold has been satisfied, the control logic 1400 then proceeds to step 1406.

At step 1406, the control logic 1400 can determine a node status. For example, the control logic 1400 can determined connections, health, temperature, location, or any other data related to the status of the node. the control logic 1400 then proceeds to step 1408.

At step 1408, the control logic 1400 can encapsulate. For example, the control logic 1400 can utilize the data from the processed packet and encapsulate such data such that the data can be retransmitted in a new data packet. In one embodiment, the encapsulated data can include a header, a payload, gateway serial number, timestamp, or any other fields suitable for a data packet. The control logic 1400 then proceeds to step 1410.

At step 1410, the control logic 1400 can determine configured connections. For example, the control logic 1400 can determine which connections are configured on a device implementing the control logic 1400, such as an infrastructure node. In another example, the control logic 1400 can iterate through its connection list to determine which connections are configured. The control logic 1400 then proceeds to step 1412.

At step 1412, the control logic 1400 can determine whether a first connection type is configured. For example, the control logic 1400 can determine if the connections determined at step 1410 include a first connection type. In one embodiment, the first connection type can be a 220 megahertz connection type. In another embodiment, the first connection type can be any connection type suitable to communicate with a PTC infrastructure. In another embodiment, the first connection type can be any connection type suitable to communicate. If the control logic 1400 determines that the first connection type is not configured, the control logic 1400 then proceeds to step 1414. If you control logic determines that the first connection type is configured, the control logic 1400 then proceeds to step 1418.

At step 1414, the control logic 1400 can set a node definition to a first type. In one embodiment, a first type of node definition can be a repeater node. For example, a repeater node can be configured to receive correspondence from one or more infrastructure nodes in a network and continue to forward such correspondence on until a node is reached with the first connection type configured. In another embodiment, the first node type can be any node without the first connection type configured. The control logic 1400 then proceeds back to step 1410 to continue to determine configured connections and to step 1416.

At step 1416, the control logic 1400 can transmit the node status to the infrastructure nodes. For example, the control logic 1400 can determine that because the first connection type is not configured, that the control logic 1400 should transmit to infrastructure nodes opposed to a server node. For example, the control logic 1400 can transmit the encapsulated node status data via a communication protocol utilized by infrastructure nodes in the network. In another embodiment, the control logic 1400 can determine that because the first connection type is not configured, that the control logic should act as a repeater node and transmit information to other infrastructure nodes in the network. The control logic then proceeds to step 1424.

At step 1418, the control logic 1400 can set a node definition to a second type. In one embodiment, a second type of node can be a collector node. For example, a collector node can be configured to receive transmissions from one or more infrastructure nodes and forward such transmissions to a server node connected to the network. In another embodiment, a second type of node can be any node with the first connection type configured. The control logic 1400 then proceeds to step 1420.

At step 1408, the control logic 1400 can re-encapsulate. For example, the control logic 1400 can utilize the data from the processed packet and re-encapsulate such data such that the data can be retransmitted in a new data packet. In one embodiment, the re-encapsulated data can include a header, a payload, gateway serial number, timestamp, or any other fields suitable for a data packet. The control logic 1400 then proceeds to step 1422.

At step 1422, the control logic 1400 can transmit the re encapsulated node status data to the server node. For example, the control logic 1400 can determine that because the first connection type is configured, that the infrastructure node should transmit to the server node. For example, because the first connection type is configured, the control logic 1400 can determine that the infrastructure node on which the control logic 1400 is implemented should act as a collector node and therefore forward information to the server node. The control logic then proceeds to step 1424.

At step 1424, the control logic 1400 can await a packet. For example, the control logic 1400 can be prepared to receive a data packet, such as from an infrastructure node and/or a server node and/or any other constituent of the network. The control logic 1400 can then terminate or repeat any of the aforementioned steps.

Figure 12:
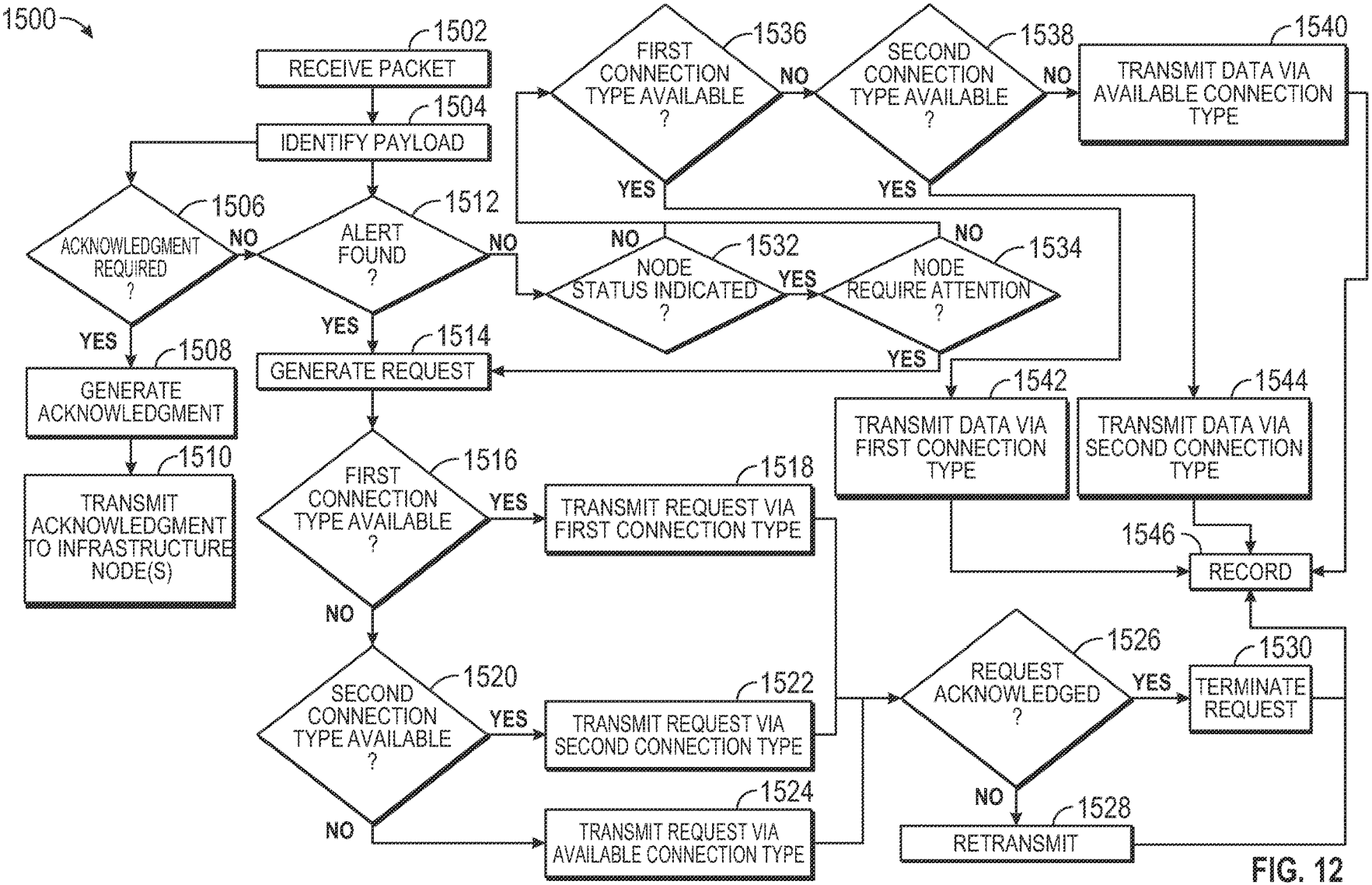
FIG. 12 illustrate a flow chart of a node oversight system, in accordance with one or more exemplary embodiments of the present disclosure.

FIG. 12 illustrates a flow chart diagram 1500 exemplifying control logic embodying features of a node oversight system 1500, in accordance with an exemplary embodiment of the present disclosure. The node oversight logic 1500 can be implemented as an algorithm on a node (e.g., server node 304), a machine learning module, or other suitable system. Additionally, the node oversight control logic 1500 can implement or incorporate one or more features of the mesh network oversight system 500, including the connectivity supervisor system 502, the data supervisor system 504, and/or the communications supervisor system 506. The node oversight control logic 1500 can be achieved with software, hardware, an application programming interface (API), a network connection, a network transfer protocol, HTML, DHTML, JavaScript, Dojo, Ruby, Rails, other suitable applications, or a suitable combination thereof.

The node oversight control logic 1500 can leverage the ability of a computer platform to spawn multiple processes and threads by processing data simultaneously. The speed and efficiency of the node oversight control logic 1500 is greatly improved by instantiating more than one process to facilitate personnel safety. However, one skilled in the art of programming will appreciate that use of a single processing thread may also be utilized and is within the scope of the present disclosure.

The node oversight control logic 1500 process flow of the present embodiment begins at step 1502, wherein the control logic 1500 receives a packet. In one embodiment, the packet can be from an infrastructure node. In another embodiment, the packet can be a data packet. In another embodiment, the packet can include a header, a payload, ID/gateway serial number, a timestamp, a payload type code, payload specific data, a cyclic redundancy check (CRC), and/or a message. The control logic 1300 then proceeds to step 1504.

At step 1504, the control logic 1500 can identify a payload. For example, the control logic 1500 can process and/or the data packet received it step 1502 and identify the payload within the packet. In another embodiment, the control logic 1500 can review the contents of the payload to determine its character and/or content. The control logic 1500 then proceeds to steps 1506 and At step 1506, the control logic 500 can determine whether an acknowledgement is required. For example, the control logic can identify the payload at step 1504 and determine whether the payload requires acknowledgement of receipt. If the control logic 1500 determines that acknowledgement is required, the control logic 1500 then proceeds to step 1508. If the control logic 1500 determines that acknowledgement is not required, the control logic 1500 then proceeds to step 1512.

At step 1508, the control logic 1500 can generate an acknowledgment. For example, the control logic 1500 can generate an acknowledgement that can inform one or more nodes on the network that the payload was received. The control logic 1500 then proceeds to step 1510.

At step 1510, the control logic 1500 can transmit the acknowledgement to infrastructure nodes on the network. For example, the control logic 1500 can broadcast an acknowledgement such that each infrastructure node knows that a particular payload was received. In another embodiment, the control logic 1500 can transmit the acknowledgement to a single node on the network that can then broadcast to the other infrastructure nodes, such as via a communication protocol utilized by the infrastructure nodes. The control logic 1500 can then terminate or repeat any of the aforementioned steps.

At step 1512, the control logic 1500 can determine whether an alert was found in the payload. For example, the control logic 1500 can compare the payload with one or more alert thresholds to determine whether an alert is included in the payload. In another embodiment, the packet received at step 1502 can include information in the packet that can indicate to the control logic 1500 that the packet is an alert. If the control logic 1500 finds an alert, the control logic then proceeds to step 1514. If the control logic 1512 does not find an alert, the control logic 1500 then proceed to step 1532.

At step 1514, the control logic 1500 can generate a request. For example, the control logic 1500 can be in operable communication with one or more systems suitable to receive alerts and/or requests. In another embodiment, the control logic 1500 can generate a request to address the alert. In one embodiment, the control logic 1500 can generate a request for maintenance to address the alert. In another embodiment, the request generated at step 1514 can include data related to the alert, including the location, node, type of alert, or any other information related to the alert and/or source thereof. The control logic 1500 then proceeds to step 1516.

At step 1516, the control logic 1500 can determine whether the first connection type is available. For example, the first connection type can be configured on the infrastructure node, but can nevertheless be unavailable, such as do to malfunction, lack of reception, etc. If the control logic 1500 determines that the first connection type is available, the control logic 1500 then proceeds to step 1518. If the control logic 1500 determines that the first connection type is not available, the control logic 1500 then proceed to step 1520.

At step 1518, the control logic 1500 can transmit the request via the first connection type. For example, the verse connection type can be a connection type having the highest priority to the control logic 1500. For example, the control logic 1500 can be configured to always transmit via the first connection type if it is available. In another embodiment, the first connection type can be any connection type suitable to enable the control logic 1500 to communicate with one or more nodes in the network. the control logic 1500 then proceeds to step 1526.

At step 1520, the control logic 1500 can determine whether a second connection type is available. For example, the control logic 1500 can determine that if the first connection type is not available, that the control logic 1500 should then search for the second connection time period and one embodiment, the second connection type can have a lower priority than the first connection type, such that the control logic 1500 will only transmit via the second connection type if the first connection type is not available. In another embodiment, the second connection type can be any suitable connection type to enable the control logic 1500 to communicate with one or more nodes in the network. If the control logic 1500 determines that the second connection type is available, the control logic 1500 then proceeds to step 1522. If the control logic 1500 determines that the second connection type is not available, the control logic 1500 then proceeds to step 1524.

At step 1522, the control logic 1500 can transmit the request via the second connection type. In one embodiment, the second connection type can be a cellular network, or any other suitable network. The control logic 1500 then proceeds to step 1526.

At step 1524, the control logic 1500 can transmit the request via and available connection type. For example, the control logic 1500 can determine that because the first and second connection types were unavailable, the control logic 1500 should determine the next available connection type and transmit via such connection type. The control logic 1500 then proceeds to step 1526.

At step 1526, the control logic 1500 can determine if the request has been acknowledged. For example, the control logic 1500 can await an acknowledgment from a receiving system and/or node regarding whether the request generated at step 1514 has been acknowledged. If the control logic 1500 determines that the request has not been acknowledged, the control logic then proceeds to step 1528. If the control logic 1500 determines that the request has been acknowledged, the control logic then proceeds to step 1530.

At step 1528, the control logic 1500 can retransmit the request. For example, the control logic 1500 can determine that because the request has not yet been acknowledged, that the requests should be retransmitted such that the control logic 1500 can ensure that the request is received. The control logic 1500 then proceeds to step 1546.

At step 1530, the control logic 1500 can terminate transmission of the request. For example, the control logic 1500 can determine that because the request was acknowledged, transmission of the request should be terminated. The control logic 1500 then proceeds to step 1546.

At step 1532, the control logic 1500 can determine whether a node status was indicated. For example, the control logic 1500 can analyze the packet received step 1502 to determine whether the packet contains data related to the node status. In another embodiment, the control logic 1500 can determine whether the payload of the packet received at step 1502 includes node status information. If the control logic 1500 determines that the node status was indicated, the control logic 1500 then proceeds to step 1534. If the control logic 1500 determines that the node status was not indicated, the control logic 1500 then proceeds to step 1536.

At step 1534, the control logic 1500 can determine whether the node from which the packet originated requires attention. For example, the packet received at step 1502 can include data related to the origination of the data packet. In one embodiment, the control logic 1500 can analyze the data packet and determine whether the status indicated by the node means that the node requires attention. For example, the node status can indicate whether the node needs repairs, reconfiguration, or other attention. If the control logic 1500 determines that the node requires attention, the control logic 1500 then proceeds step 1514. If the control logic 1500 determines that the node does not require attention, the control logic 1500 then proceeds to step 1536.

At step 1536, the control logic 1500 can determine whether the first connection type is available. For example, the first connection type can be configured on the infrastructure node, but can nevertheless be unavailable, such as do to malfunction, lack of reception, etc. If the control logic 1500 determines that the first connection type is available, the control logic 1500 then proceeds to step 1542. If the control logic 1500 determines that the first connection type is not available, the control logic 1500 then proceed to step 1538.

At step 1542, the control logic 1500 can transmit the data via the first connection type. For example, the first connection type can be a connection type having the highest priority to the control logic 1500. For example, the control logic 1500 can be configured to always transmit via the first connection type if it is available. In another embodiment, the first connection type can be any connection type suitable to enable the control logic 1500 to communicate with one or more nodes in the network. The control logic 1500 then proceeds to step 1526.

At step 1538, the control logic 1500 can determine whether a second connection type is available. For example, the control logic 1500 can determine that if the first connection type is not available, that the control logic 1500 should then search for the second connection time period and one embodiment, the second connection type can have a lower priority than the first connection type, such that the control logic 1500 will only transmit via the second connection type if the first connection type is not available. In another embodiment, the second connection type can be any suitable connection type to enable the control logic 1500 to communicate with one or more nodes in the network. If the control logic 1500 determines that the second connection type is available, the control logic 1500 then proceeds to step 1544. If the control logic 1500 determines that the second connection type is not available, the control logic 1500 then proceeds to step 1540.

At step 1544, the control logic 1500 can transmit the data via the second connection type. In one embodiment, the second connection type can be a cellular network, or any other suitable network. The control logic 1500 then proceeds to step 1526.

At step 1540, the control logic 1500 can transmit the data via and available connection type. For example, the control logic 1500 can determine that because the first and second connection types were unavailable, the control logic 1500 should determine the next available connection type and transmit via such connection type. The control logic 1500 then proceeds to step 1526.

At step 1546, the control logic 1500 can record. For example, the control logic 1500 can record data received in the packet at step 1502. In another embodiment, the control logic 1500 can record requests sent, data sent, connections available, time, node status, and/or any other data relevant to the packet received and/or the processing of the packet. The control logic 1500 can then terminate or repeat any of the aforementioned steps.

The present disclosure achieves at least the following advantages:

1. Providing an enhanced long-range communications infrastructure that can enable monitoring and devices and/or equipment in remote locations;
2. Enhancing bandwidth efficiency by utilizing a mesh network with distributed processing capabilities;
3. Providing a new use for existing communications infrastructure by enabling data packet efficiency via distributed processing;
4. Maximizing network coverage via distributed infrastructure nodes configured to integrate into the network and self-define based on configured connection types;
5. Providing an alert communication methodology for railroad infrastructure with increased reliability and usability; and
6. Avoiding increased costs due to technology obsolescence by providing a mesh network capable of communicating via one or more communication protocols, including, e.g., LoRa.

Persons skilled in the art will readily understand that these advantages (as well as the advantages indicated in the summary) and objectives of this system would not be possible without the particular combination of computer hardware and other structural components and mechanisms assembled in this inventive system and described herein. It will be further understood that a variety of programming tools, known to persons skilled in the art, are available for implementing the control of the features and operations described in the foregoing material. Moreover, the particular choice of programming tool(s) may be governed by the specific objectives and constraints placed on the implementation plan selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosure can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A method for alert generation and handling in a railroad infrastructure, comprising:

receiving, via a second node having a second processor, sensor data related to a railroad asset;

generating an alert if the sensor data satisfies an alert threshold;

determining at least one configured connection type;

defining the second node as a first node type if a first connection type is not configured on the second node;

defining the second node as a second node type if the first connection type is configured on the second node;

transmitting the alert to a third node if a first node is the first node type; and transmitting the alert to the first node if the second node is the second node type.

2. The method of claim 1, further comprising the first node:

receiving the alert;

generating an acknowledgment;

transmitting the acknowledgment to at least the second node;

generating a request; and transmitting the request.

3. The method of claim 2, further comprising the first node:

determining if the request is acknowledged;

retransmitting the request if the request is not acknowledged; and terminating the request if the request is acknowledged.

4. The method of claim 1, wherein the second node is located proximate a railroad track.

5. The method of claim 1, wherein the second node is located at a crossing house.

6. The method of claim 1, wherein the railroad asset is a railroad crossing.

7. The method of claim 1, wherein the second node transmits the alert to the third node via a LoRa protocol.

8. The method of claim 1, wherein the third node is of the second node type.

9. A method of integrating a node into a railroad monitoring infrastructure, the system comprising:

receiving, via an infrastructure node having a first processor, a first packet having first data;

determining whether on-node processing is required and at least one configured connection type;

defining the infrastructure node as a first node type if a first connection type is not configured on the infrastructure node;

defining the infrastructure node as a second node type if the infrastructure node is configured with the first connection type;

repeating the first packet via a second connection type if the infrastructure node is defined as the first node type; and processing the first packet to generate a second packet having second data if the infrastructure node is defined as the second node type.

10. The method of claim 9, further comprising the infrastructure node transmitting the second packet via the first connection type if the infrastructure node is defined as the second node type and the first connection type is available.

11. The method of claim 9, further comprising the infrastructure node transmitting the second packet via a third connection type if the at least one infrastructure node is of the second node type and the first connection type is not available.

12. The method of claim 9, further comprising the infrastructure node:

determining, using the first packet, if acknowledgment is required;

requesting acknowledgment if acknowledgment is required; and terminating transmission of the first or second packet if acknowledgment is received.

13. The method of claim 12, further comprising the server node generating a first request and transmitting the first request if the second data includes an alert.

14. The method of claim 9, further comprising:

receiving, via a server node having a second processor, the second packet;

identifying, via a server node, the second data;

generating, via a server node, an acknowledgment if the second data requires acknowledgment; and transmitting, via a server node, the acknowledgment to the infrastructure node.

15. The method of claim 14, further comprising the server node:

determining if the second data includes a node status;

generating a second request if the node status indicates that node attention is required; and transmitting the second request.

16. The method of claim 9, further comprising the infrastructure node:

determining if the first data has reached a first destination;

if the first destination has been reached, processing the first packet, determining if acknowledgment is required, and, if acknowledgment is required, transmitting an acknowledgment.

17. The method of claim 9, wherein the infrastructure node includes a first memory having a plurality of data, thresholds, and specifications related to railroad assets.

18. A method of integrating a node into a railroad monitoring infrastructure, the system comprising:

determining, via a first node having a first processor, if a temporal threshold has been satisfied;

determining a node status of the first node after the temporal threshold has been satisfied;

encapsulating processed packet data and retransmitting an encapsulated data packet;

determining one or more connection types for the first node;

defining the first node as a first node type if the first node is not configured with a first connection type;

transmitting the node status to an infrastructure node.

19. The method of claim 9, wherein the node status includes node connections, health, temperature, and location.

20. The method of claim 9, further comprising:

defining the first node as a second node type if the first node is configured with a first connection type; and transmitting the node status to a server node.

* * * * *